US005952978A

United States Patent [19]

VanVoorhies

[11] Patent Number: 5,952,978

[45] Date of Patent: Sep. 14, 1999

[54] CONTRAWOUND TOROIDAL ANTENNA

[75] Inventor: Kurt Louis VanVoorhies, DeTour Village, Mich.

[73] Assignee: VorteKx, Inc., DeTour Village, Mich.

[ * ] Notice: This patent is subject to a terminal disclaimer.

[21] Appl. No.: 08/937,344

[22] Filed: Sep. 20, 1997

Related U.S. Application Data

[63] Continuation of application No. 08/514,609, Aug. 14, 1995, Pat. No. 5,734,353.

[51] Int. Cl.[6] ..... H01Q 11/12

[52] U.S. Cl. ..... 343/742; 343/744; 343/748; 343/866; 343/895

[58] Field of Search ..... 343/742, 743, 343/744, 746, 748, 788, 866, 867, 870, 895; H01Q 11/12

[56] References Cited

U.S. PATENT DOCUMENTS

| | | |
|---|---|---|
| 1,792,964 | 2/1931 | Brooks et al. . |
| 2,712,603 | 7/1955 | Bridges et al. . |
| 2,740,113 | 3/1956 | Hemphill . |
| 2,841,791 | 7/1958 | Schlicke . |

(List continued on next page.)

FOREIGN PATENT DOCUMENTS

| | | |
|---|---|---|
| 548541 | 1/1982 | Australia . |
| 1186049 | 4/1985 | Canada . |
| 0043591 A1 | 1/1982 | European Pat. Off. . |
| 3823972 A1 | 1/1990 | Germany . |

OTHER PUBLICATIONS

*ARRL Antenna Handbook*, 1991, pp. 25–12 through 25–14.

Yung, E.K.N., and Lee, W.S., "A Magnetic Current Loop Array In A Paraolic Reflector", IEEE Antennas and Propagation Society International Symposium, 1992 Digest, Jul. 20–24, 1992, vol. 4, pp. 1832–1835, Chicago, Illinois, U.S.A..

Van Voorhies, K.L., *The Segmented Bifilar Contrawound Toroidal Helical Antenna*, vol. I–III, Ph.D. Dissertation, 1993 (Unpublished except for Abstract which was published by University Micorfilms International, Ann Arbor, Michigan, U.S.A., on Dec. 15, 1994 in vol. 55, Issue 6B of Dissertation Abstracts).

(List continued on next page.)

*Primary Examiner*—Don Wong
*Assistant Examiner*—Tho Phan
*Attorney, Agent, or Firm*—Kurt L. Van Voorhies

[57] ABSTRACT

An electrically small antenna is disclosed that is constructed from a generalized contrawound toroidal helix made from a single continuous conductor divided into two length portions each of which are substantially the same length and which have a generalized helical pattern. The helical pitch senses the two length portions are opposite to one another. The two length portions are insulated from one another and overlap one another on the surface of a generalized toroid. A signal is fed to the antenna at a port defined by the node locations where the respective length portions join one another, or at a diametrically opposite point. At the fundamental mode of operation, the antenna is a half guided wavelength in circumference. The size of the antenna is further reduced because of the slow-wave properties of the underlying generalized contrawound toroidal helix. The antenna is omnidirectional with vertical polarization with a radiation pattern similar to an electric dipole, but in a physical package that is substantially smaller. A compact, broadband embodiment of the antenna is disclosed, as are other applications including a coaxial cavity resonator using the antenna as a feed element.

55 Claims, 20 Drawing Sheets

U.S. PATENT DOCUMENTS

| | | | |
|---|---|---|---|
| 2,915,637 | 12/1959 | McAdam . | |
| 2,957,103 | 10/1960 | Birdsall . | |
| 3,284,801 | 11/1966 | Bryant . | |
| 3,646,562 | 2/1972 | Acker et al. . | |
| 3,721,989 | 3/1973 | Christensen | 343/788 |
| 3,740,837 | 6/1973 | Robinson, Jr. . | |
| 4,004,179 | 1/1977 | Phillips . | |
| 4,008,478 | 2/1977 | Ikrath et al. . | |
| 4,017,863 | 4/1977 | Tharp et al. . | |
| 4,057,462 | 11/1977 | Jassby et al. . | |
| 4,263,097 | 4/1981 | Ohkawa . | |
| 4,516,133 | 5/1985 | Matsumoto et al. . | |
| 4,622,558 | 11/1986 | Corum . | |
| 4,751,515 | 6/1988 | Corum . | |
| 4,808,929 | 2/1989 | Oldigs . | |
| 4,890,115 | 12/1989 | Hartings . | |
| 5,274,907 | 1/1994 | Moorehead . | |
| 5,331,729 | 7/1994 | Moorehead . | |
| 5,361,737 | 11/1994 | Smith et al. . | |
| 5,442,369 | 8/1995 | VanVoorhies et al. . | |
| 5,495,259 | 2/1996 | Lyasko . | |
| 5,654,723 | 8/1997 | Craven et al. . | |

OTHER PUBLICATIONS

Bowman, D. F., "Impedance Matching and Broadbanding," In Johnson, R.C. ed., *Antenna Engineering Handbook,* 1993, McGraw–Hill, p. 43–1 through 43–32.

PCT International Searching Authority, International Application No. PCT/US96/09119, International Search Report or the Declaration, Sep. 13, 1996.

Kandoian, A.G.; W., "Wide–Frequency–Range Tuned Helical Antennas and Circuits" Convention Record of the IRE, 1953 National Convention, Part 2—Antennas and Communications, pp. 42–47.

Birdsall, C.K.; Everhart, T.E. "Modified Contra–Wound Helix Circuits for High Power Traveling Wave Tubes," IRE Transactions on Electron Devices, ED–3, Oct. 1956, pp. 190–204.

Nevins, J.E., Jr., "An Investigation and Application of the Contrawound Helix," IRE Transactions on Electron Devices, ED–6, 1959, 195–202.

Ham, J.M.; Slemon, G.R.*Scientific Basis of Electrical Engineering,* John Wiley & Sons, N.Y., 1961, pp. 303–305.

Harrington, R.F.*Time–Harmonic Electromagnetic Fields,* McGraw Hill, N.Y., U.S.A., 1961, pp. 106–111.

Krall, N.K. and Trivelpiece, A.W., *Principles of Plasma Physics,* San Francisco Press, Inc., San Francisco, California, U.S.A., 1986, pp. 267–286.

Garnier, R.C., *Study of a radio frequency antenna with an edge–slot like structure,* Ph.D. Dissertation, Marquette University, Milwaukee, WI, 1987, pp. 1–24.

Corum, J.F.; Corum, K.L., "Toroidal Helix Antenna," Proceedings of the 1987 IEEE—Antennas and Propagation Society International Symposium, Blacksburg, Virginia, 1987, pp. 832–835.

Pinzone, B.F.; Corum, J.F.; Corum, K.L., "A New Low Profile Anti–Skywave Antenna for AM Broadcasting," Proceedings of the 1988 National Association of Broadcasters 42nd Engineering Conference, Las Vegas, Nevada, Apr. 1988, pp. 7–15.

Tiberio, C.A.; Raganella, L.; Banci, G.; Franconi, C., "The RF Toroidal Transformer as a Heat Delivery System for Regional and Focused Hyperthermia," IEEE Transactions on Biomedical Engineering, 35,12 (Dec. 1988), pp. 1077–1085.

Van Voorhies, K.L. and Smith, J.E., "The Promises and Prospects of Worldwide Wireless Power Transfer: An Overview," 26th Intersociety Energy Conversion Engineering Conference, Aug. 4–9, 1991, 6 pp., Boston, Massachusetts, U.S.A..

CONTRAWOUND TOROIDAL ANTENNA

CROSS-REFERENCE TO RELATED APPLICATIONS

This application is a continuation of application Ser. No. 08/514,609 filed Aug. 14, 1995 now U.S. Pat. No. 5,734, 353.

BACKGROUND OF THE INVENTION

The performance of electromagnetic antennas is measured with respect to the distance in a given direction or set of directions over which a given amount radio frequency (RF) power applied to the antenna's input terminals can propagate while having a signal strength above a given threshold. Performance is also measured with respect to the frequency bandwidth over which this can occur. An antenna comprises a collection of radiating elements which convert electrical energy to radiating photons, and the geometry and size of these elements determine the intrinsic radiation pattern of the antenna, representing the distribution of radiated power as a function of angular orientation with respect to the coordinate system in which the antenna is located. The radiation pattern indicates the ability of the antenna to concentrate energy along a given direction or set of directions, and the orientation of the peak of the radiation pattern gives the direction over which the propagation distance in free space will be greatest. The efficiency of the radiation process—i.e. the process of converting electrical energy to radiating photons—is dependent upon the operating frequency and is measured by what is termed here a radiation bandwidth. An antenna also exhibits a frequency dependent complex impedance at its input port or ports which affects the ability of the antenna to absorb power from a given source. This frequency dependency of the input impedance is characterized by the antenna's input impedance bandwidth. The net bandwidth of the antenna is dependent upon both the radiation bandwidth and the impedance bandwidth. An electrical matching network is generally placed between the antenna input port and the feed source to match the impedance of the antenna to that of the power source so as to maximize the amount of real power conducted into and absorbed by the antenna. Some of this absorbed real power is converted to heat due to ohmic losses in the conductive elements comprising the antenna, while the remainder is radiated by the antenna. The impedance bandwidth at the input to the matching network is generally different from that of the antenna. The performance of an antenna is dependent upon the ability of the antenna to absorb electrical energy conducted into the antenna input port, as indicated by the input impedance and impedance bandwidth, and upon the ability of the antenna to convert the conducted electrical energy to radiating photons, as indicated by the radiation pattern and radiation bandwidth. In operation, the orientation of the antenna, and with that the antenna's radiation pattern, relative to that of a given receiving antenna, will affect the maximum propagation distance that can be achieved for a given communications link between the two antennas.

The direction of polarization of an electromagnetic wave is given by the direction of the corresponding electric field component. If the direction of polarization is fixed, the wave is said to be linearly polarized, while if the direction of polarization rotates about the axis of wave propagation, the wave is said to be circularly polarized. The arts pertaining to electromagnetic radiation and propagation generally recognize that electromagnetic waves of a given energy which are linearly polarized in a vertical direction relative to the Earth's surface, i.e. vertically polarized, will propagate farther than corresponding electromagnetic waves of other polarizations. Vertically polarized waves are commonly created with resonant dipoles, or grounded quarter wave monopoles, oriented along a vertical axis. For a dipole, the length of the antenna at resonance—the operating frequency for greatest efficiency—is such that the antenna supports one half of a standing wave. While propagating on or along the antenna structure, the wave is referred as a guided wave, and the guided wavelength is generally about 95% of the free space wavelength for an electric dipole. The length of a resonant quarter-wave monopole will be one quarter of a guided wavelength. The physical size, especially the length, of these resonant dipole and monopole antennas can be a significant disadvantage, especially at low frequencies and for applications requiring a portable, vehicular mounted antenna.

A number of alternative means have been devised for reducing the size, or more particularly the length, of resonant dipole or monopole antennas. When operated at non-resonant frequencies, and particularly at frequencies where the resonant dipole or monopole antenna is electrically short or small, i.e. where the physical length of the antenna is shorter than the corresponding half or quarter guided wavelength, the input impedance becomes complex and likely unmatched to the power source, thereby reducing the amount of power that can be absorbed by the antenna. Matching circuits can be used to compensate for this effect and to thereby increase the efficiency of electrically short antennas, and these matching circuits can comprise either passive or active electrical networks. A dipole or monopole antenna can also be constructed with helically wound conductors, whereby the resonance length is governed by the length of the wire and the velocity factor of the helical wave guiding structure, while the antenna length is governed by the overall, and generally significantly shorter, length of the helix. A plurality of electrically short dipole or monopole antennas may also be operated as a phased array to as to concentrate the radiation power in a given direction. The benefits of reduced size in these alternative configurations, however, are generally obtained with the disadvantage of either reduced gain, or increased complexity or cost.

It will be appreciated by one with ordinary skill in the art that a single conductor may comprise a variety of embodiments, including but not limited to a single-element conductor comprising a wire, foil or printed circuit element, each of arbitrary cross section, either solid or hollow; a multi-element conductor comprising a plurality of non-insulated single-element conductors; or a plurality of single-element conductors or multi-element conductors which are insulated from one another; such that a signal applied across two nodes defined at distinct locations along the single conductor is applied across each such conductive element thereof, thereby causing a current to flow in each such element in accordance with Ohm's law. The aforementioned single-element conductor may further comprise a variety of embodiments, including but not limited to a homogeneous or stratified conductive medium, or one or more segments of distinct homogeneous or stratified conductive media conductively joined to one another.

A low profile, i.e. short, vertically polarized antenna would be useful for a number of applications. These applications include portable communications equipment, such as on air, sea and land vessels and vehicles; where the physical length of a protruding antenna could either adversely affect aerodynamic drag, interfere with obstacles, or be overly conspicuous. These applications could also include low frequency land based communications where the height of the antennas is hazardous to aircraft and undesirable to neighboring residents. These tall antennas are also expensive to build and to maintain.

The radiation from an electric dipole or monopole antenna results from the spatial distribution of electric currents associated with the associated standing current waves on the antenna structure. The electric currents oscillate along the linear path of the antenna, and the direction of electric current corresponds to the direction of polarization of the resulting associated radiated wave. Applying the principle of duality of electromagnetic fields, a vertically polarized antenna can also be constructed in principle by replacing electric current sources with their equivalent magnetic current sources, where magnetic current is proportional to the time rate of change of the magnetic flux density B. A loop of uniform magnetic current is roughly equivalent to a linear electric current, whereby the axis of the loop of magnetic current is coincident with the line defining the linear electric current. Therefore for duality with an electric dipole or monopole antenna, the corresponding magnetic loop would be located in a plane normal to the electric dipole or monopole antenna. For a vertically polarized dipole or monopole, the magnetic loop will be in the horizontal plane.

Magnetic loop currents can be created with toroidal helical structures. An elementary toroidal helix comprises a single helical conductor which follows a path along the surface of a torus. The defining toroidal surface has a major axis and a minor axis, and corresponding radii. The major axis is normal to the plane of the torus, while the minor axis forms a circle whose radius is equal to the major radius of the torus. The toroidal surface is then defined as that surface whose distance from the minor axis is equal to the minor radius of the torus. The resonance properties of the toroidal helical structure are related to the length of the conductor, and the geometry of is associated toroidal helix. The physical height of this structure, when oriented in a horizontal plane as necessary for vertical polarization, is governed by the minor diameter of the toroidal helical structure. Since this height is generally significantly smaller than the corresponding resonant half or quarter wavelength, this structure has a low physical profile relative to that of a corresponding dipole or monopole antenna.

The prior art teaches various applications of elementary toroidal helical antennas. Ham, J. M. and Slemon, G. R. in *Scientific Basis for Electrical Engineering*, John Wiley & Sons, N.Y., 1961, 303–305 illustrate the use of the electric field created along the major axis of an elementary toroidal helix for accelerating charged particles. U.S. Pat. No. 3,646,562 teaches the use of an elementary toroidal helical coil to couple RF energy into a live tree via the electric field created along the major axis of the elementary toroidal helical coil for purposes of using a tree as a large antenna. While simple in construction, a disadvantage of the elementary toroidal helix is that in addition to creating a loop of magnetic current, the elementary toroidal helix also creates an associated loop of electric current, whereby the combined effects of the electric and magnetic loop currents produces a composite radiation pattern which differs from that of an electric dipole, and more particularly the radiated field contains both vertical and azimuthal components.

U.S. Pat. Nos. 4,622,558 and 4,751,515; related Canadian Patent 548,541; and Australian Patent 1,186,049 have disclosed three different groups of embodiments—referred as groups of prior art embodiments, infra—for canceling the azimuthal component of radiation gain present in the elementary toroidal helical antenna.

The first group of prior art embodiments comprise a plurality of closed interconnected ring elements, which are based upon the modified contrawound helix disclosed for use in traveling wave tubes by Birdsall, C. K. and Everhart, T. E. in "Modified Contra-Wound Helix Circuits for High-Power Traveling-Wave Tubes," *IRE Transactions on Electron Devices*, ED-3 (October 1956), 190–204. A typical linear contrawound helix comprises two coaxial helical windings, the helical pitch senses of each which are opposite to one another. If the electric currents in the separate windings are in phase, called the symmetric mode of operation, then the associated axial magnetic fields created by the separate helical winding elements cancel one another, while the corresponding electric fields reinforce one another. If the electric currents in the separate windings are of opposite phase, called the anti-symmetric mode of operation, then the axial magnetic fields reinforce one another, while the axial electric fields cancel one another. When applied to traveling wave tubes, the contrawound helix is normally operated in the symmetric mode. The modified contrawound helix of Birdsall and Everhart comprises a single conductor disposed as a series of poloidal ring elements interconnected with axial bar elements. At resonance, this modified contrawound helix operates similar to a bifilar contrawound helix. The condition for this mode of operation is that the circumferential length of the ring elements be on the order of a half wavelength. The first group of embodiments utilize a series of four modified contrawound helical elements disposed on a toroidal surface, whereby each element is fed in phase from a common signal source, and whereby each element would operate in the anti-symmetric mode so as to create a loop of quasi-uniform magnetic current without an associated loop of electric current.

The second group of prior art embodiments utilize first and second substantially closed, elongated conductors helically wound in bifilar relation on same toroidal surface. The conductors in these embodiments are shown having a continuous pitch sense. A given pair of windings is shown fed at diametrically opposite points on the toroidal helical structure, and a phase shift network is described in conduction with an embodiment having four toroidal helical conductors that are wound in parallel with a common, continuous helical pitch sense.

The third group of prior art embodiments are image plane variants of first group of prior art embodiments, supra, sectioned along the plane of the minor axis of the toroidal structure and including an image plane coincident with the sectioning plane. These embodiments utilize the principle of electrical imaging whereby a conductive image plane creates the electrical equivalent to the mirror image of the physical antenna structure above the image plane.

The associated toroidal helical structure for all three groups of prior art embodiments is taught to be at least one guided wavelength in circumference. The associated teachings also describe how the antennas are sized for a given operating frequency according to the relations from Kandoian, A. G. and Sichak, W., "Wide-Frequency-Range Tuned Helical Antennas and Circuits," *Convention Record of the IRE,* 1953 *National Convention, Part 2—Antennas and Communications*, pp. 42–47 for the propagation properties of waves on linear helical structures based upon the results from infinite sheath helices. However, U.S. patent application Ser. No. 07/992,970, infra, discloses that these relations were found to be in error by as much as a factor of 2 to 3 when applied to the operation of bifilar contrawound helical elements. The design relations for a toroidal helical antenna structure are used to determine the size and helical pitch of the associated toroidal helix for a given frequency of operation. The first and third groups of prior art embodiments also have the implicit limitation according to the theory of modified contrawound toroidal helical structures that the circumference of the rings must be on the order of a half wavelength in order to operate as a vertically polarized antenna. Since the ring diameter establishes the antenna height, this can be a constraining factor for some applications.

The prior art teaches the use of edge-slot structures for creating omnidirectional vertically polarized radiation fields wherein, according to Garnier, R. C., *Study of a Radio Frequency Antenna with an Edge-Slot Like Structure*, Ph.D. Dissertation, Marquette University, 1987, UMI Order Number 8716862 (which references U.S. Pat. No. 4,051,480) a toroidal shell structure with an circular resonant peripheral slot gap is fed from a pair of central internal nodes from inside the shell. This results in poloidal conduction currents on the shell structure in series with a displacement current across the peripheral slot, in contradistinction to the toroidal helical structures for which the currents are conducted by toroidal helical windings and for which there are no gaps in series with the conductive elements and across which must flow displacement currents.

An improved toroidal helical antenna is disclosed in U.S. patent application Ser. No. 07/992,970. This antenna uses a bifilar contrawound toroidal helical winding divided into four equi-angular segments each segment of which is one quarter guided electrical wavelength in length, wherein the helical pitch sense is reversed across segment boundaries, the junctions at segment boundaries comprise feed ports, and where the signal is fed at each of the feed ports. A two segment embodiment with a circumference of a half wavelength is also disclosed, for which the signal is simultaneously fed at two feed ports. These embodiments utilize multiple parallel feeds and corresponding feed matching networks. The contrawound helical windings are operated in an anti-symmetric mode wherein the magnetic loop currents created thereby are reinforced, and the associated loop electric current components effectively cancel one another. This improved toroidal helical antenna theoretically has a pure linear radiation polarization along the major axis of the associated toroid form, with near omnidirectionality in the azimuthal plane, and is not constrained to having a poloidal circumference of approximately one half wavelength as required of toroidal antenna embodiments constructed with ring-bar style modified contrawound helix windings, supra.

The improved toroidal helical antenna, supra, however, requires multiple, parallel signal feeds which are more complex to match and tune than would be a single feed port, because the separate feed networks can influence the operation of the antenna and can interact with one another. Also, the four segment embodiment of this antenna is one electrical wavelength in circumference. The two segment embodiment, while only a half wavelength in circumference, also requires multiple simultaneous feeds and operates at a low impedance resonance condition which has inherently lower bandwidth than the high impedance resonance condition at which the four segment embodiment operates.

In view of the above limitations of the prior art devices, one of the objects of the instant invention is to provide a physically low profile antenna with a specific communications range that is extended relative to that of prior art devices.

A further object of the instant invention is to provide an antenna which is linearly polarized, such that the antenna has a physically low profile along the direction of polarization.

A yet further object of the instant invention is to provide an antenna which is omnidirectional, or approximately so, in directions that are normal to the direction of polarization.

A yet further object of the instant invention is to provide an antenna whose radiation gain is maximal in directions normal to the direction of polarization, and which is minimal in the direction or polarization.

A yet further object of the instant invention is to provide an antenna which has a simplified feed configuration that can be readily matched to a source of RF power.

A yet further object of the instant invention is to provide an antenna which operates over as wide a bandwidth as possible.

SUMMARY OF THE INVENTION

The instant invention is an electrically small electromagnetic device that can be used for transmitting or receiving electromagnetic fields in a variety of applications covering a range of propagation distances, including usage as an antenna—for communications or energy transfer,—an antenna feed element, an electromagnetic cavity feed element, an accelerator of charged particles, or a plasma energizer and confinement. In one embodiment, the instant invention uses a continuous, i.e. endless, conductor formed into a contrawound toroidal helix. The continuous conductor forming this contrawound toroidal helix is conceptually divided into two separate length portions, each of substantially the same length and having a uniform helical pitch sense—right hand or left hand—over its respective length, with the separate length portions having opposite helical pitch senses and overlapping one another so as to form a contrawound toroidal helix.

A balanced time varying electric current signal is applied at a feed port located on the contrawound toroidal helix, each terminal of the feed port being located on a different length portion of the continuous conductor, causing currents to flow simultaneously in opposite directions within the separate length portions. The current in each respective helically formed length portion creates a time varying magnetic field, i.e. a magnetic current, having a direction along the axis of the helix, relative to the direction of the associated electric current, according to the "right hand rule". Since the respective helical pitch senses of the two length portions that form the contrawound toroidal helix are in opposite directions, and since the respective electric currents in each length portion are also in opposite directions, the resulting magnetic currents created by the separate length portions of the contrawound toroidal helix reinforce one another, while at the same time the field effects of the corresponding electric currents effectively cancel one another, so that the net effect is a quasi-uniform magnetic current loop. A quasi-uniform magnetic current loop is similar in effect to an line of electric current which is located along the axis of the magnetic current loop. An electric dipole antenna, or the equivalent grounded monopole antenna, creates an omnidirectional vertically polarized electromagnetic field from a line of electric current.

An electromagnetic field is created similar to that of the electric dipole antenna by using electric currents along a contrawound toroidal helical structure to create a quasi-uniform loop of magnetic current with a physical package that is significantly shorter than the equivalent dipole or monopole antennas, and which is smaller in breadth than the ground plane normally required for grounded monopole antennas. The contrawound toroidal helix of the instant invention is one half guided wavelength in circumference, which is half the size of prior art devices. The size of the instant invention is further reduced from some prior art devices because the instant invention uses a contrawound form of bifilar helix, for which the speed of guided electromagnetic waves is significantly smaller than for a parallel-wound bifilar helix. The instant invention is also simpler to construct and operate since it requires only a single signal feed port.

More particularly, as one feature, the instant invention comprises a bifilar contrawound toroidal helical conductive path whose axial length is one half of a guided wavelength at the intended nominal operating frequency.

As another feature of the instant invention, the helical pitch sense of the bifilar contrawound toroidal helical conductive paths is, for two of the embodiments which are denoted as series/loop fed, reversed where the paths intersect an azimuthal plane, while the helical pitch sense is reversed at two such planes which are diametrically opposite to one another in the embodiment denoted as parallel/transmission line fed, whereby each conductive path is continuous, so that for the series/loop fed embodiments, the instant invention comprises a single distinct endless conductive path, and for the parallel/transmission line fed embodiment, the instant invention comprises two distinct endless conductive paths.

As yet another feature of the instant invention, the signal can be fed at one port, which for the parallel transmission line fed embodiment, is located at one of the places of helical pitch sense reversal, which for one of the series/loop fed embodiments—also the overall preferred embodiment—is located at the place of helical pitch sense reversal, and which for the other series fed embodiment is located diametrically opposite to the place of helical pitch sense reversal. Multiple fed embodiments are also contemplated by the instant invention, although they are not necessarily preferred because of the relative complexity and sensitivity of the corresponding phase and impedance matching networks.

The specific features of the instant invention provide a number of associated advantages. One advantage of the instant invention with respect to the prior art is the reduction in the major diameter of the toroidal helix. At resonance, the length of the circumference of the minor toroidal axis of the instant invention is a half wavelength, which is half that of the comparable improved toroidal antenna, supra. In comparison with the antennas comprising parallel bifilar toroidal helical windings which behave according to the Kandoian and Sichak design relations, the wave propagation velocity along the contrawound helical paths of the instant invention is about 2 to 3 times slower than that predicted by the Kandoian and Sichak design relations. This enables the major diameter of the instant invention to be reduced with respect to those bifilar toroidal helical antennas by a factor of 4 to 6. The major diameter of the instant invention is reduced with respect to the length of a linear antenna by both the effects of slow wave propagation, and by the circular nature of the instant invention having its electrical length projected along the major axis of a torus.

Another advantage of the instant invention is that the minor diameter is not coupled to, and therefor limited by, the operating frequency, as is the case for ring-bar embodiments which operate according to the Birdsall and Everhart theory of modified contrawound helical waveguides.

As yet another advantage, the instant invention requires only a single feed port, which simplifies the task of matching the antenna input impedance to that of the transmission line. By comparison, the improved toroidal antenna, supra, requires simultaneously matching both the phase and the impedance of the four independent feed ports to that of a common central signal port.

As yet another advantage, the fundamental resonance of each of the series/loop fed embodiments of the instant invention has a wide bandwidth in comparison with the respective first harmonic resonances so that the instant invention exhibits its widest bandwidth at the intended operating frequency.

As yet another advantage, the preferred embodiment of the instant invention was found to have a considerably greater specific communications range over sea water, and to receive signals more strongly, than a comparable grounded monopole antenna.

BRIEF DESCRIPTION OF THE DRAWINGS

These and other aspects of the invention will now be described in detail with reference to the accompanying drawings, wherein.

DESCRIPTION OF THE INVENTION

Figure 1:
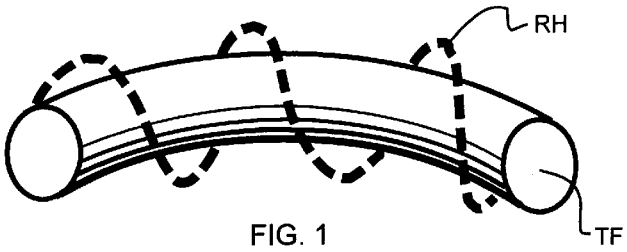
FIG. 1 is a portion of a right-hand pitch sense toroidal helix.

The instant invention comprises a generalized contrawound toroidal helix, constructed from a continuous conductor, whose purpose is to transform an input electrical current signal into a loop of magnetic current that omindirectionally radiates with linear polarization in a direction normal to the plane of the loop. A generalized contrawound toroidal helix comprises the combination of two separate length portions overlaying one another around and over the surface of a generalized toroid, each length portion having a generalized helical pattern that locally has an associated helical pitch sense—either right or left hand in the conventional sense—whereby the separate respective helical pitch senses of the separate length portions at a given location along the axis of the generalized helical pattern are opposite to one another. The contrawound helix element of the generalized contrawound toroidal helix is contrawound in the conventional bifilar sense of having two distinct helical paths when considered at a particular location along the contrawound helix, in contradistinction to the Birdsall and Everhart modified contrawound helix, supra, for which there is only one distinct path or conductor—albeit one which is periodically forked—at any particular location along the contrawound helix.

A contrawound helix constructed from distinct conductive paths is useful for creating electromagnetic fields for which along the axis of the contrawound helix, the composite magnetic field is enhanced by constructive interference while the corresponding composite electric field is canceled by destructive interference, and vice versa, the composite fields being given by the additive combination of the respective fields from each separate helix element of the contrawound helix. An electric current on a helical conductor creates a magnetic field directed along the axis of the associated helix. A time varying electric current creates a time varying magnetic field, which is also known as a magnetic current. The direction of the electric current on the helical structure can be expressed as the component of the instantaneous current direction projected onto the axis of the helix, thereby enabling the directions of the electric and magnetic currents to be compared with one another. Applying this technique together with the well known right hand rule for relating the directions of electric currents and associated magnetic fields, the directions of electric and magnetic current are the same for a helical conductor with a right-hand pitch sense, but are opposite one another for a helical conductor with a left-hand pitch sense. Since the contrawound helix has conductive paths of both helical pitch sense in proximity to one another, if the electric currents along the respective paths are in phase with one another in what is known as a symmetric mode of operation, the associated composite electric current will be enhanced, while the associated composite magnetic current will be canceled. However, if the electric currents along the respective paths are out of phase with one another in what is known as an anti-symmetric mode of operation, the associated composite magnetic current will be enhanced, while the associated composite electric current will be canceled. Normally, a contrawound helix is constructed from distinct conductors, however the instant invention teaches that a generalized contrawound toroidal helix can be constructed from a single conductor, and that this embodiment has many associated advantages which enable the construction of an electrically and physically small antenna that is useful for a variety of applications.

The generalized contrawound toroidal helix has a wide range of embodiments, encompassing generalizations of both the shape of the constituent toroidal form, and the nature of the constituent helical conductive elements. Examples of these generalizations are illustrated in FIGS. 1–34.

Figure 2:
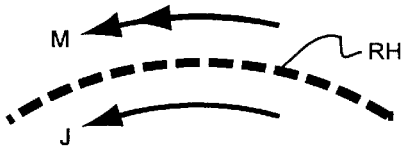
FIG. 2 is a schematic rendition of FIG. 1.
Figure 3:
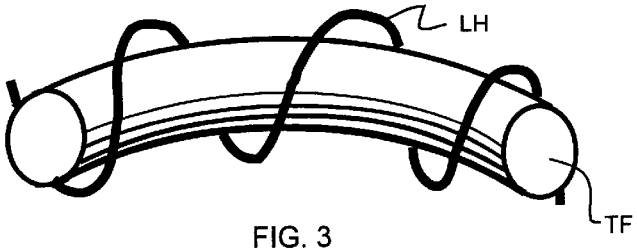
FIG. 3 is a portion of a left-hand pitch sense toroidal helix.
Figure 4:
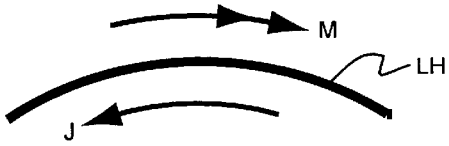
FIG. 4 is a schematic rendition of FIG. 3.
Figure 5:
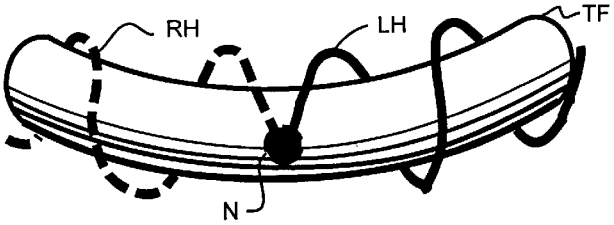
FIG. 5 is a portion of a toroidal helix with a node located at a point of pitch sense reversal.
Figure 6:
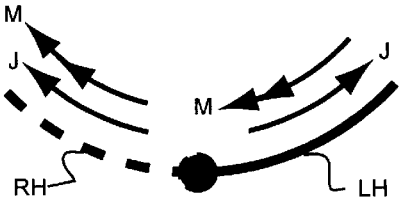
FIG. 6 is a schematic rendition of FIG. 5.
Figure 7:
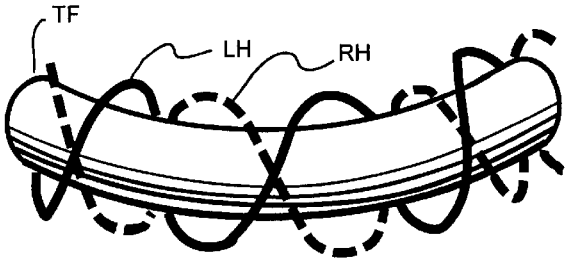
FIG. 7 is a bifilar contrawound toroidal helix.
Figure 8:
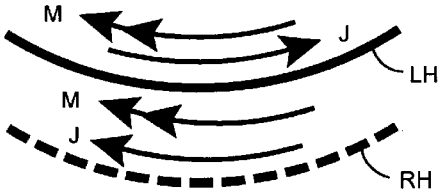
FIG. 8 is a schematic rendition of FIG. 7.
Figure 9:
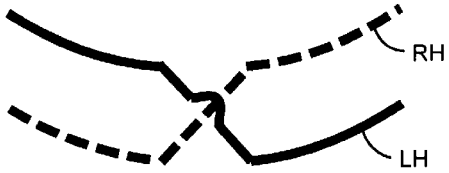
FIG. 9 is an alternate schematic rendition of FIG. 8 depicting an X-Junction.
Figure 10:
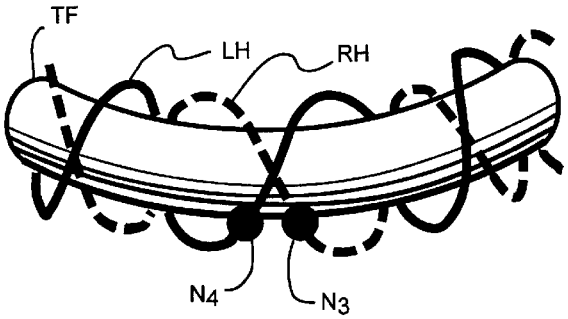
FIG. 10 is a bifilar contrawound toroidal helix with an X-Junction feed port.
Figure 11:
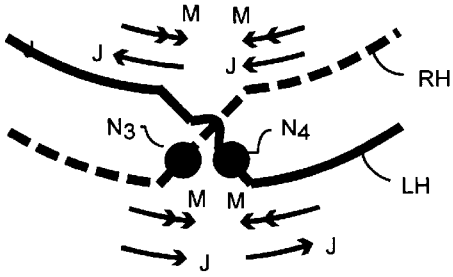
FIG. 11 is a schematic rendition of FIG. 10.
Figure 12:
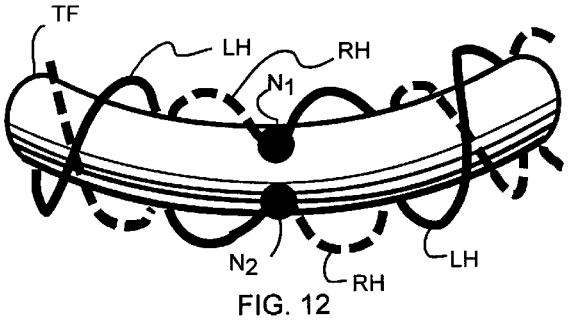
FIG. 12 is a bifilar contrawound toroidal helix with an H-Junction feed port.
Figure 13:
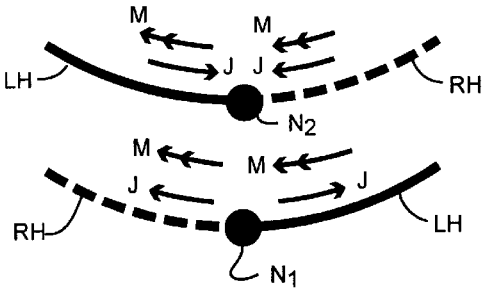
FIG. 13 is a schematic rendition of FIG. 12.
Figure 14:
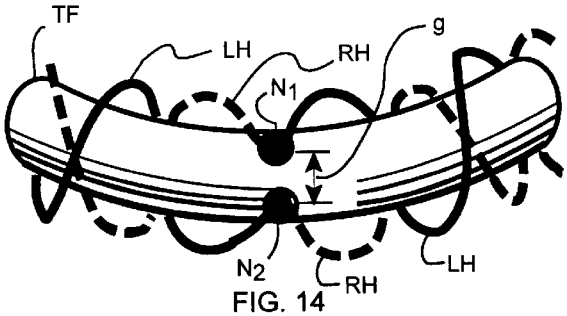
FIG. 14 is an illustration of the proximate location of nodes at a feed port.

FIGS. 1–14 illustrate physical and schematic renditions of various toroidal helical elements. The schematic renditions show a helix as a line, either solid for left hand helical pitch sense, or dashed for right hand helical pitch sense. A toroidal helix is shown as a circular arc. For the hypothetical electric current J shown with a single arrow, the corresponding hypothetical magnetic current M is shown with a double arrow. The toroidal helix elements are constructed on a toroidal form TF. A right-hand pitch sense toroidal helix RH is shown in FIGS. 1–2, wherein the axial projection of the electric current is in the same directing and the resulting axial magnetic current according to the right-hand rule. In contrast, FIGS. 3–4 illustrates a left-hand pitch sense toroidal helix LH for which the direction of the magnetic current is opposite to that of the electric current. The junction of left and right-hand pitch sense toroidal helical elements is referred as a node N, which is illustrated in FIGS. 5–6. This type of node will also be referred as a canonical node. If the node is connected to a signal port, electric current will flow either into or out of this node, propagating in different directions in each of the adjacent toroidal helical elements. The resulting magnetic current however flows in the same direction in each of the toroidal helical elements because of their opposite helical pitch senses. A bifilar contrawound toroidal helix is illustrated in FIGS. 7–9, and comprises a pair of toroidal helical elements, each of opposite helical pitch sense relative to the other, which for toroidal embodiments can be constructed from either one or two distinct conductors. The points where the separate toroidal helical elements cross over one another are referred as X-junctions. FIGS. 10–11 illustrates the use of an X-junction as a feed port comprising nodes N3 and N4. This type of a feed port also referred as a Hybrid-X feed port. A balanced signal connected to an X-junction feed port creates magnetic currents flowing in opposite directions in the adjacent contrawound helical winding segments. Feed ports generally comprise a pair of adjacent nodes, but in the case of the X-junction, the associated node points do not correspond to points of helical pitch sense reversal as in FIGS. 5–6. A helical pitch sense reversal in a bifilar contrawound toroidal helix creates a pair of canonical nodes N1 and N2 as illustrated in FIGS. 12–13, and if used as an interconnection to a signal source, this port is referred as an H-junction feed port. A balanced signal connected to an H-junction feed port creates magnetic currents flowing in the same direction in each of the adjacent contrawound helical winding segments. FIG. 14 illustrates that the nodes at a signal port are in proximity to one another with a separation g.

Figure 15:
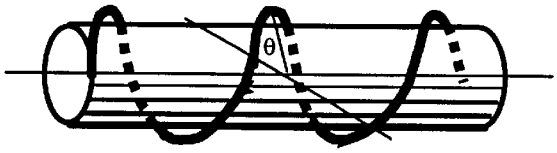
FIG. 15 is a canonical helix.
Figure 16:
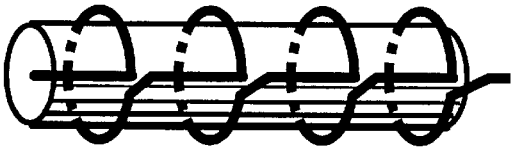
FIG. 16 is a diloop helix.
Figure 17:
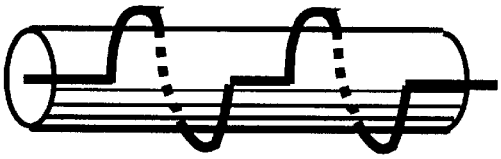
FIG. 17 is an alternate form of helix.
Figure 18:
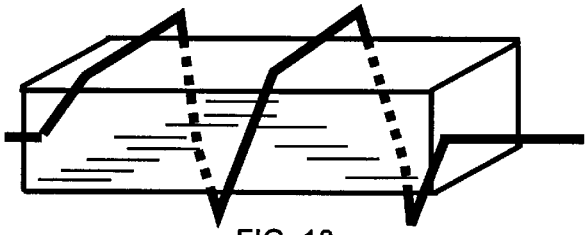
FIG. 18 is a canonical helix on a non-circular form.
Figure 19:
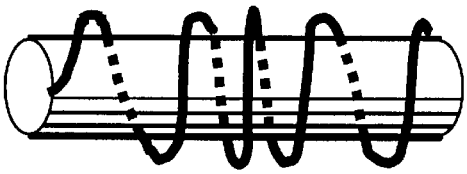
FIG. 19 is a canonical helix with a variable pitch.
Figure 20:
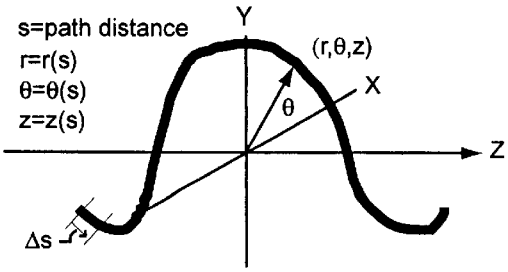
FIG. 20 is a generalized helix.

The toroidal helical windings comprising the instant invention can assume a variety of forms without departing from the spirit of the invention. FIGS. 15–20 illustrates a variety of different linear helix embodiments. FIG. 15 illustrates a canonical helix for which the rotational angle θ about the axis of the helix is linearly dependent upon the position along the axis. FIG. 16 illustrates what is known herein as a diloop which comprises a plurality of loop elements spaced apart from and interconnected in series to one another—the name is a conjunction of dipole and loop. FIG. 17 illustrates a compromise between the canonical helix and diloop embodiments. FIG. 18 illustrates that the cross section of the helix form need not be circular. FIG. 19 illustrates that the helical pitch can vary with position along helix. FIG. 20 illustrates a generalized helix where the instant coordinates of the helix are each dependent upon the path distance along the helix. For purposes of the instant invention, a helix is defined to mean a generalized helix for which the associated structure extends both around and along the defining cylindrical or toroidal form in the most general way as contemplated by FIG. 20.

Figure 21:
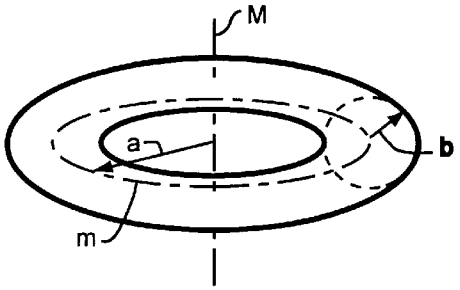
FIG. 21 is a canonical toroid embodiment of a generalized toroid.
Figure 22:
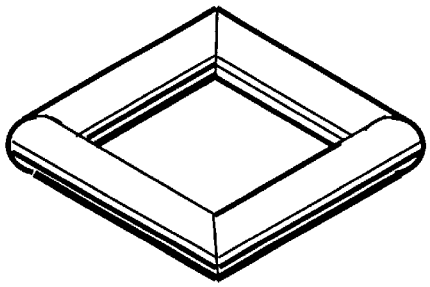
FIG. 22 is a rectangular toroid embodiment of a generalized toroid having a circular cross-section.
Figure 23:
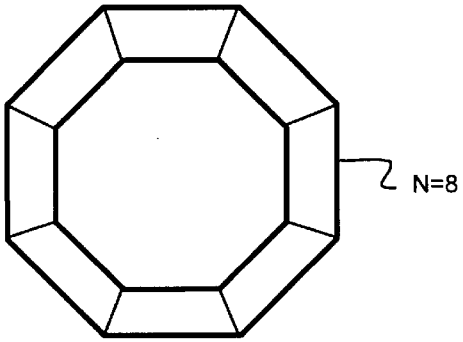
FIG. 23 is a polygonal toroid embodiment of a generalized toroid.
Figure 24:
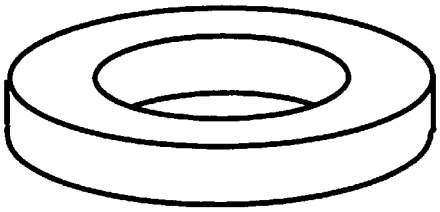
FIG. 24 is a circular toroid embodiment of a generalized toroid with a non-circular cross-section.
Figure 25:
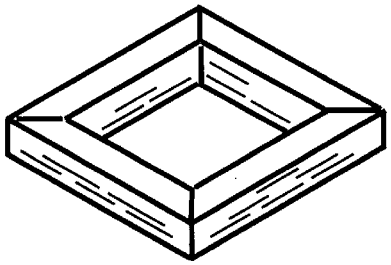
FIG. 25 is a rectangular toroid embodiment of a generalized toroid with a non-circular cross-section.
Figure 26:
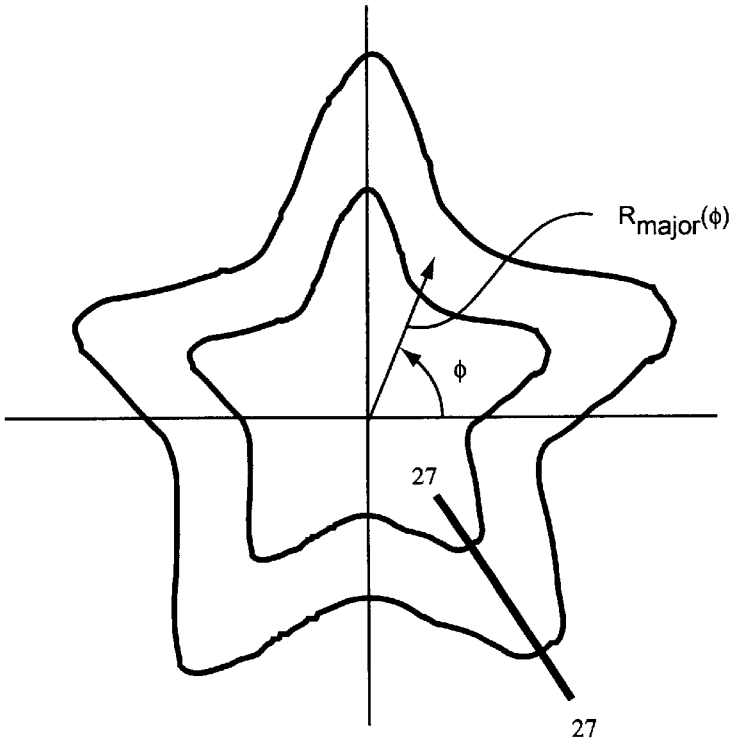
FIG. 26 is a general form of a generalized toroid.
Figure 27:
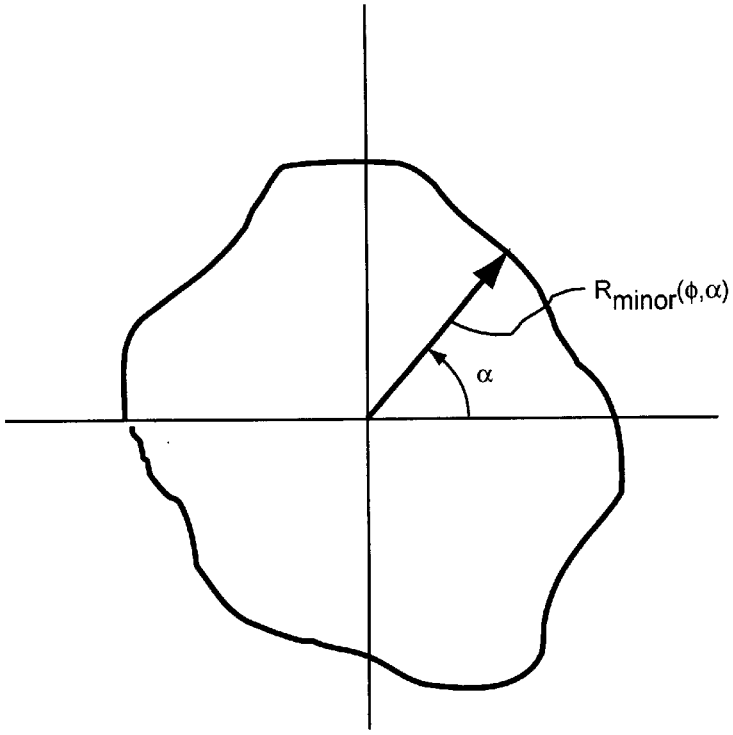
FIG. 27 is a general form of cross-section through FIG. 26.

The toroidal form that defines the bounding surface of the conductive elements of the instant invention can also assume a variety of shapes without departing from the spirit of the invention. FIGS. 21–27 illustrates a variety of different toroidal form embodiments. FIG. 21 illustrates a canonical toroid—resembling the shape of a doughnut—having a uniform circular cross section with constant major radius a with respect to major axis M, and a constant minor radius b with respect to minor axis m. FIG. 22 illustrates a toroid with a rectangular plan shape, and a uniform circular cross section. FIG. 23 illustrates a polygonal embodiment having N uniform segments. FIGS. 24 and 25 illustrate that the cross section of the toroid form need not be circular. FIG. 26 illustrates the plan shape of a generalized toroid for which the distance of the minor axis from the major axis is dependent upon the azimuthal angle ϕ about the major axis. FIG. 27 illustrates the cross sectional shape of a generalized toroid for which the distance of the toroidal surface from the minor axis can depend upon both the azimuthal angle $\phi$ about the major axis and the poloidal angle $\alpha$ about the minor axis.

The various embodiments of the instant invention are illustrated in FIGS. 28–34 using the schematic representations of FIGS. 1–14.

Figure 28:
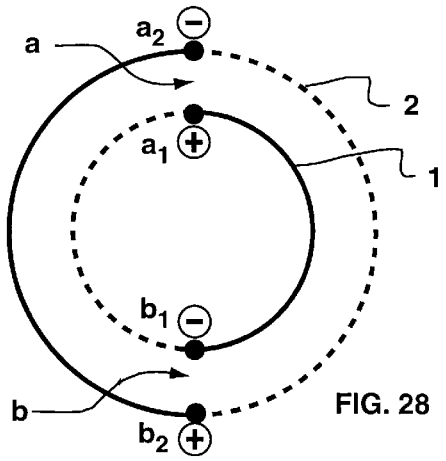
FIG. 28 is a schematic rendition of a generalized contrawound toroidal helix with a 2-port parallel/transmission line feed.

FIG. 28 illustrates a two segment embodiment, wherein the antenna comprises two distinct conductors 1 and 2 of substantially the same length in bifilar contrawound relation to one another, divided into two segments by two H-junction feed ports a and b, whereby the signal is simultaneously fed to each of the feed ports a and b respectively comprising nodes a1-a2 and b1-b2.

Figure 29:
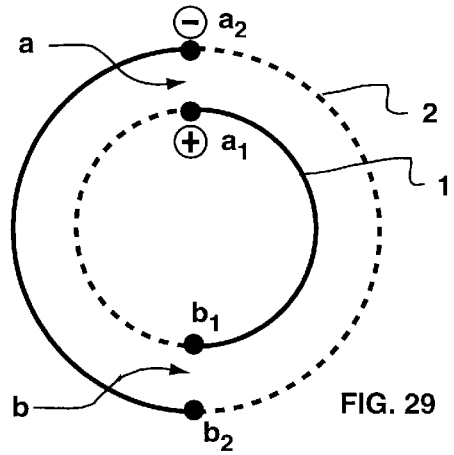
FIG. 29 is a schematic rendition of a generalized contrawound toroidal helix with a 1-port parallel/transmission line feed.

FIG. 29 illustrates an embodiment which is the same as FIG. 28 except that the signal is fed at only one of the two feed ports. The first two embodiments are referred to as parallel/transmission line feed embodiments because the two conductors comprising the antenna are separate and isolated from one another. Under DC conditions, the impedance at the feed port of this embodiment is practically infinite, while at the first resonance, the impedance is low.

Figure 30:
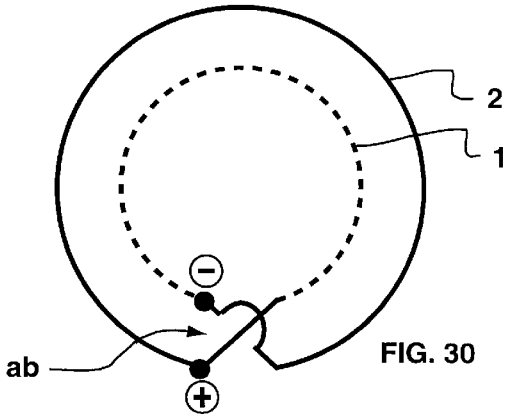
FIG. 30 is a schematic rendition of a generalized contrawound toroidal helix with a series/loop H feed.
Figure 31:
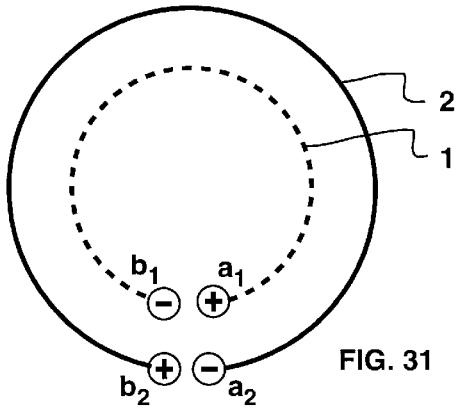
FIG. 31 is an alternate schematic rendition of FIG. 30.

FIGS. 30–31 illustrate an embodiment comprising a single, endless conductor with two length portions 1 and 2 of substantially the same length formed as a generalized contrawound toroidal helix having a single H-junction feed port ab. FIG. 31 illustrates that this embodiment can also be viewed as two separate conductors, each simultaneously fed from the same source but out of phase from one another.

Figure 32:
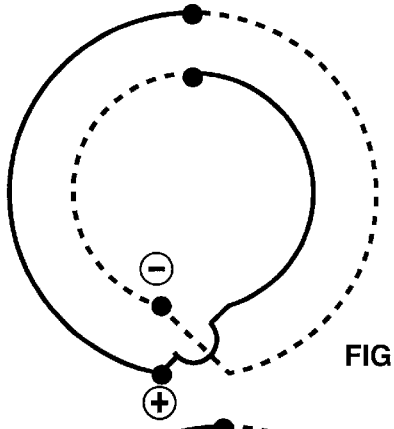
FIG. 32 is a schematic rendition of a generalized contrawound toroidal helix with a series/loop Hybrid-X feed.
Figure 33:
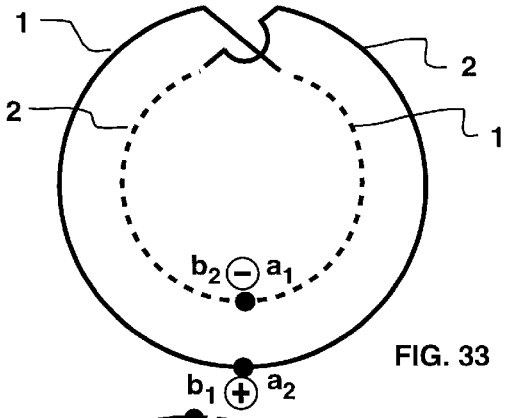
FIG. 33 is an alternate schematic rendition of FIG. 32.

FIGS. 32–33 illustrate an embodiment that is the same as the FIGS. 30–31 embodiment except for using X-junction feed port located at a point diametrically opposite to the H-junction feed port of FIGS. 30–31. Both the FIGS. 31–32 and the FIGS. 32–33 embodiments are referred as series/loop embodiments because relative to the feed port, they comprise two loops connected in parallel with one another. Under DC conditions, the impedance at the feed port of this embodiment is practically zero, while at the first resonance, the impedance is high.

Figure 34:
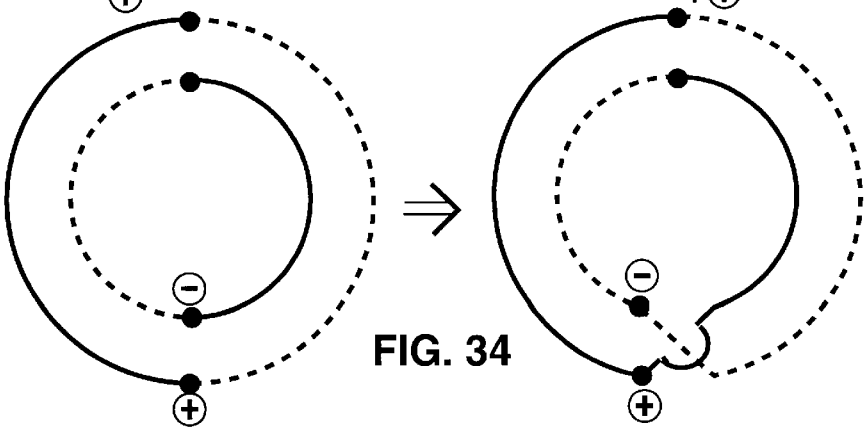
FIG. 34 shows the transformation of a parallel/transmission line feed to a series/loop Hybrid-X feed.
Figure 35:
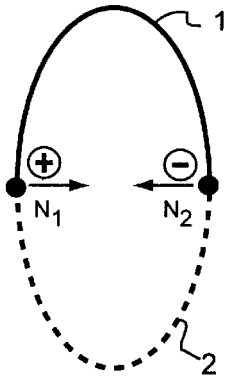
FIG. 35 shows the topology of the series/loop H feed embodiment in the form of a continuous loop.
Figure 36:
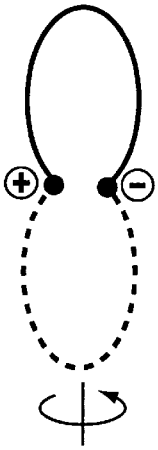
FIG. 36 shows the FIG. 35 topology after a first transformation.
Figure 37:
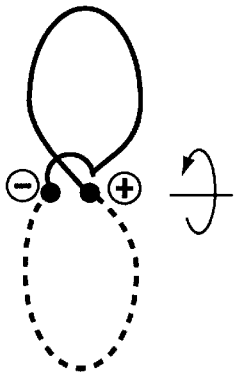
FIG. 37 shows the FIG. 35 topology after a second transformation.
Figure 38:
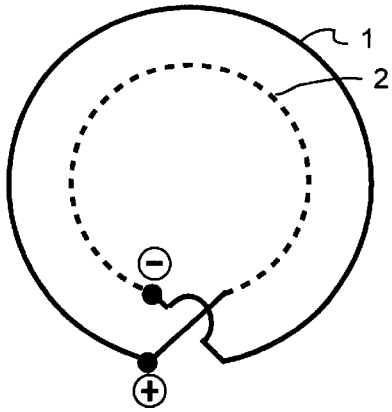
FIG. 38 shows the FIG. 35 topology after the final transformation.
Figure 39:
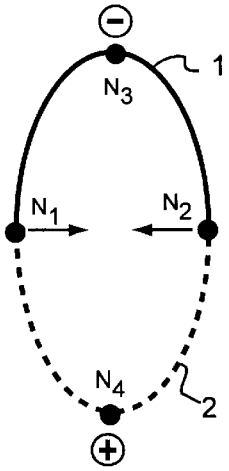
FIG. 39 shows the topology of the series/loop Hybrid-X feed embodiment in the form of a continuous loop.
Figure 40:
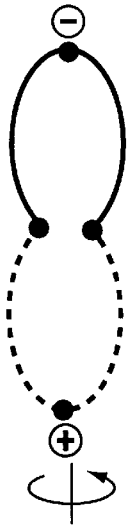
FIG. 40 shows the FIG. 39 topology after a first transformation.
Figure 41:
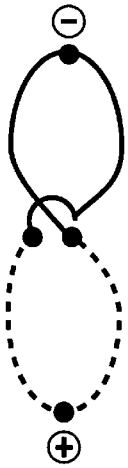
FIG. 41 shows the FIG. 39 topology after a second transformation.
Figure 42:
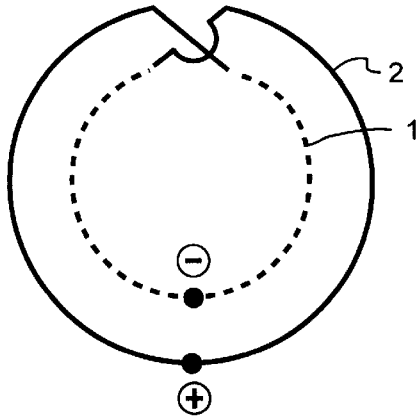
FIG. 42 shows the FIG. 39 topology after the final transformation.
Figure 43:
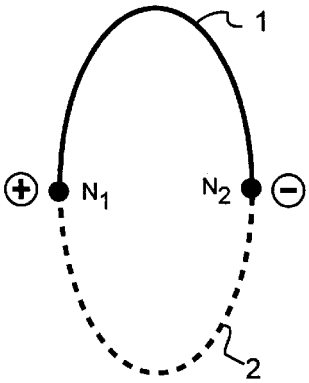
FIG. 43 shows the topology of an alternate embodiment in the form of a continuous loop.
Figure 44:
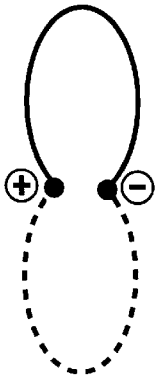
FIG. 44 shows the FIG. 43 topology after a first transformation.
Figure 45:
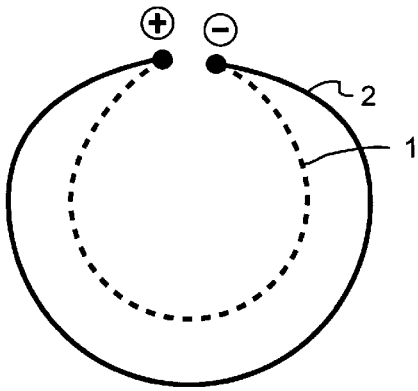
FIG. 45 shows the FIG. 43 topology after the final transformation.

FIG. 34 illustrates how the series/loop X-junction feed embodiment can be obtained by transformation from a parallel/transmission line embodiment by crossing the conductors at one of the H-junction feed ports. Because of the structure's similarity to the parallel transmission line embodiment in combination with the series/loop impedance characteristics, the feed configuration of this transformed embodiment is sometimes referred as a Hybrid-X feed.

One of the important distinctions of both of the series/loop embodiments from the prior art is that they comprise only a single distinct conductor while at the same time forming a generalized contrawound toroidal helix. The topology of these embodiments is illustrated in FIGS. 35–45, which shows how each of the series/loop embodiments can be topologically obtained from a single loop comprising two length portions 1 and 2 having diametrically opposed nodes N1–N2 or N3–N4.

The operation of each of the FIGS. 28–34 embodiments is illustrated in FIGS. 46–57. The developed form of the FIGS. 28, 29, 31, and 33 embodiments forms the basis for the axes of FIGS. 46–48, 49–51, 52–54, and 55–57 respectively, upon which various current wave forms are plotted for a hypothetical resonance condition. FIGS. 46, 49, 52, and 55 first illustrate the standing wave electric current (J-current) distribution along the direction of propagation. The associated propagation directions are labeled as CW for clockwise current propagation, and CCW for counter-clockwise current propagation. Waves emanating from the labeled positive nodes are drawn with their magnitude increasing along the associated propagation path, while waves emanating from the labeled negative nodes are drawn with their magnitude decreasing along the associated propagation path. The polarity at the feed terminals represents the associated instantaneous polarity at an instantaneous point in time. A current flowing in a given direction is equivalent to an equal but opposite magnitude current flowing in the opposite direction. FIGS. 47, 50, 53, and 56 then illustrate the respective standing wave electric current distributions with all polarities referenced to the counter-clockwise direction of propagation. A given time varying electric current in a helical structure creates an associated magnetic current. The direction of the magnetic current is the same as the associated electric current in a right-hand pitch sense helix, while the direction of the magnetic current is opposite to that of the associated electric current in a left-hand pitch sense helix. FIGS. 48, 51, 54, and 57 then illustrate the respective standing wave magnetic current distributions with all polarities referenced to the counter-clockwise direction of propagation. One of the stated objectives of the instant invention is to achieve vertical polarization, which in the context of FIGS. 46–57 is satisfied by a net cancellation of the electric current shown in FIGS. 47, 50, 53, and 56 together with a reinforcement of the magnetic current shown in FIGS. 48, 51, 54, and 57.

Figure 46:
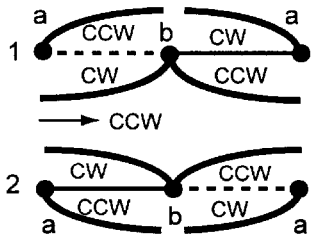
FIG. 46 is the electric current distribution, with directions referenced to the nodes, for the embodiment of FIG. 28.
Figure 47:
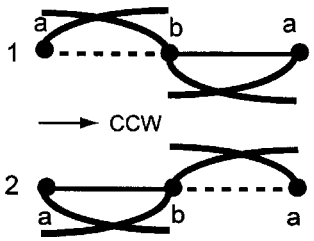
FIG. 47 is the counter-clockwise electric current distribution for the embodiment of FIG. 28.
Figure 48:
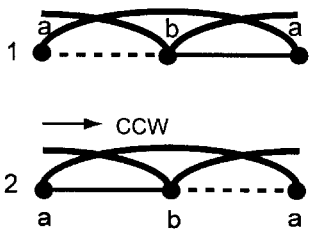
FIG. 48 is the counter-clockwise magnetic current distribution for the embodiment of FIG. 28.

FIGS. 46–48 shows that the parallel/transmission line embodiment fed at two ports produces a quasi-uniform azimuthal magnetic current distribution with no associated net azimuthal electric current, which satisfies the conditions necessary to create a vertically polarized radiation field similar to that of an electric dipole.

Figure 49:
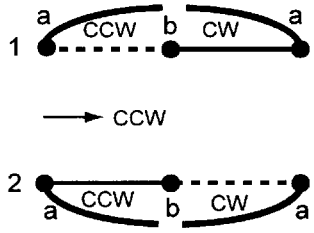
FIG. 49 is the electric current distribution, with directions referenced to the nodes, for the embodiment of FIG. 29.
Figure 50:
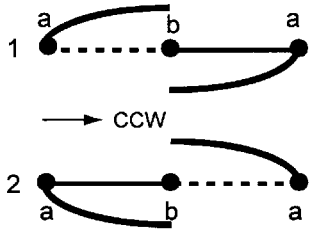
FIG. 50 is the counter-clockwise electric current distribution for the embodiment of FIG. 29.
Figure 51:
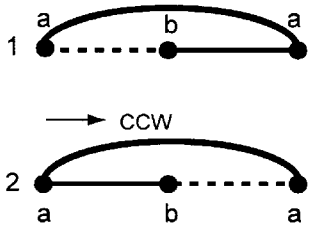
FIG. 51 is the counter-clockwise magnetic current distribution for the embodiment of FIG. 29.

FIGS. 49–51 shows that the parallel/transmission line embodiment fed at one port produces a single lobed azimuthal magnetic current distribution no associated net azimuthal electric current. While this appears to be a non-uniform current distribution from the developed view of the structure, in the physical structure, the node and antinode of this distribution are diametrically opposite to one another, while the locations in quadrature to these points share a common current magnitude equal to 0.707 times the peak magnitude. The radiation from a given point on the solenoid will proceed in both directions, and since the instant invention is electrically small, i.e. the physical size is small in comparison with the free space wavelength associated with the operating frequency, the phase delay between signals from diametrically opposed radiation sites will be small. Therefore, the circular structure of the antenna will average out the effective source magnitude with respect to azimuthal positions of the field measurement point.

Figure 52:
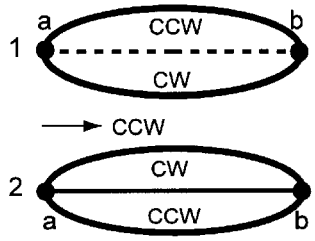
FIG. 52 is the electric current distribution, with directions referenced to the nodes, for the embodiment of FIG. 31.
Figure 53:
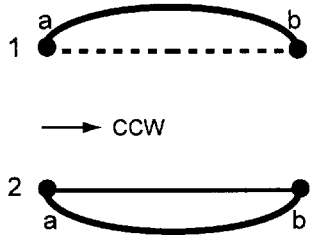
FIG. 53 is the counter-clockwise electric current distribution for the embodiment of FIG. 33.
Figure 54:
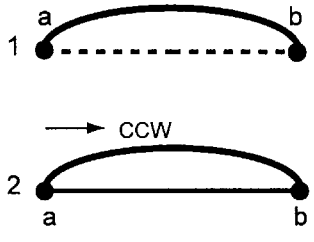
FIG. 54 is the counter-clockwise magnetic current distribution for the embodiment of FIG. 31.

FIGS. 52–54 shows the series/loop embodiment with an H-junction feed port. The magnetic current distribution is identical to that of the FIGS. 49–51 embodiment, also with no associated net azimuthal electric current. The radiation patterns of both the FIGS. 49–51 and FIGS. 52–54 embodiments therefore approximate that of a resonant electric dipole oriented normal to the plane of, and centered within, the instant inventive structure.

Figure 55:
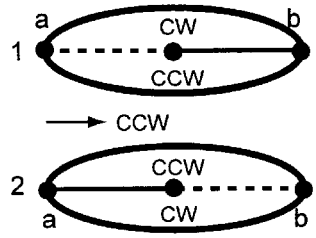
FIG. 55 is the electric current distribution, with directions referenced to the nodes, for the embodiment of FIG. 33.
Figure 56:
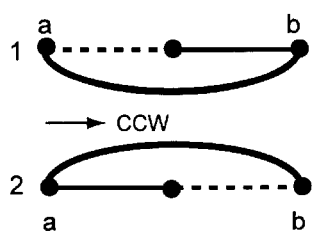
FIG. 56 is the counter-clockwise electric current distribution for the embodiment of FIG. 33.
Figure 57:
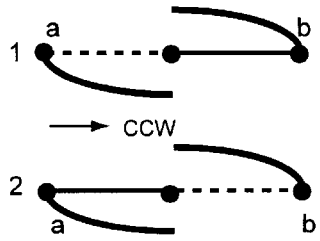
FIG. 57 is the counter-clockwise magnetic current distribution for the embodiment of FIG. 33.

FIGS. 55–57 shows the series/loop embodiment with a Hybrid-X junction feed port. This embodiment has a two phase magnetic current distribution, with no associated net azimuthal electric current.

Figure 58:
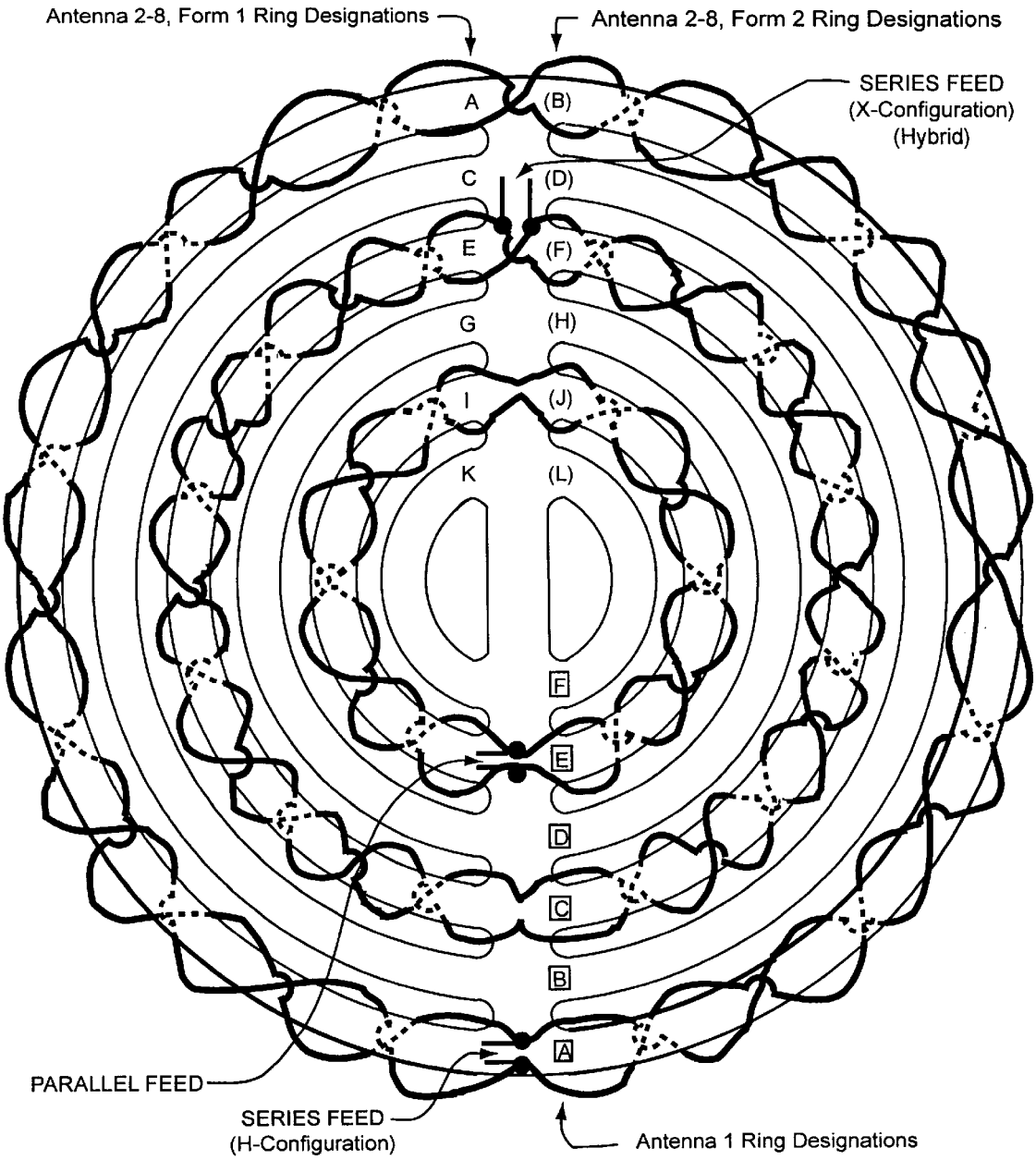
FIG. 58 is a multi-ring toroidal helical antenna configuration illustrating various generalized contrawound toroidal helix configurations.

The bandwidth of a single bifilar toroidal helical embodiment of the instant invention is about 10%. A plurality of these individual embodiments can be combined in a common structure comprising a series of concentric toroidal forms, such as shown in FIG. 58, each form comprising a separate ring of this multi-ring concentric structure. The windings associated with each ring are tuned to distinct frequencies which are separated so that the frequency bands associated with each ring element are adjacent to, or slightly overlapping, one another. While the set of rings used in the working examples, infra, were co-planer, they need not be limited to a common plane in order to fulfill the spirit of this invention. For example, the rings could also be spaced along their common major axis, as in a Tower of Hanoi puzzle. FIG. 58 also illustrates the physical form of the various types of feed configurations illustrated in FIGS. 28–34.

Figure 59:
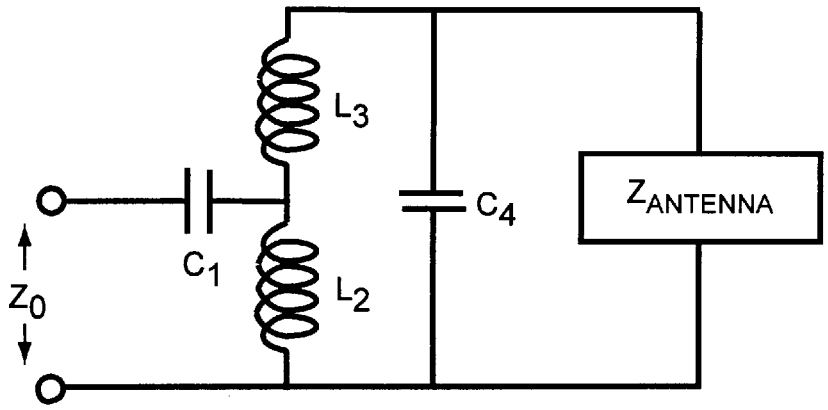
FIG. 59 is one form of an impedance matching network used in various embodiments of the instant invention.
Figure 60:
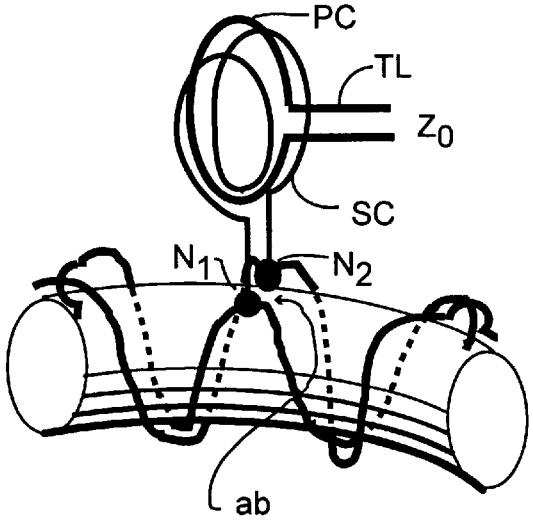
FIG. 60 is a magnetic loop signal coupler with a conductive connection to a generalized contrawound toroidal helix at a signal feed.
Figure 61:
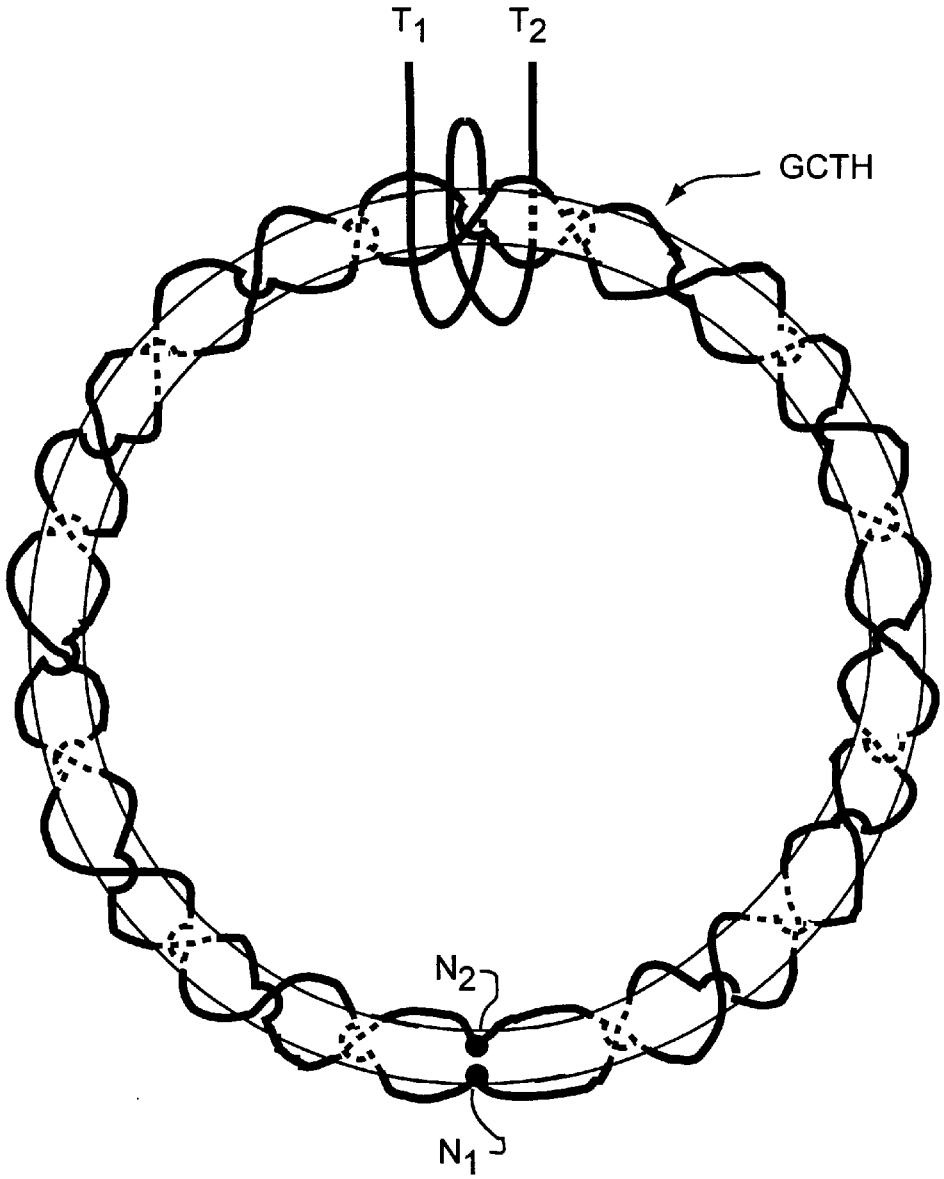
FIG. 61 is a magnetic loop signal coupler with a magnetic inductive connection to a generalized contrawound toroidal helix at a signal feed.

The input impedance of the generalized contrawound toroidal helix was found to be on the order of 1–3 KΩ. This impedance must be matched to the characteristic impedance of the associated interconnected signal feed transmission line, which is typically 50Ω. The Series-Parallel impedance matching network of FIG. 59 was particularly useful for performing this matching function, while maintaining a high bandwidth, and was used for several of the working embodiments, infra, of the instant invention. This network is described in the 1988 edition of the *ARRL Antenna Handbook*. In general, an impedance matching network can be part of a signal coupler which couples the signal between the signal source, which is normally some form of transmission line, and a signal feed on the antenna. A signal feed is a location on the antenna where the signal is coupled to the windings of the antenna using a given feed mechanism. Feed mechanisms can include both electric current conduction, as illustrated in FIGS. 58 and 60, or by magnetic induction directly to the generalized contrawound toroidal helix as illustrated in FIG. 61. A variety of forms of signal couplers are contemplated, the most simple of which is simply a direct connection to the signal feed whereby the signal is conducted from the source to a feed port on the antenna. The signal might also be coupled using magnetic induction, as illustrated in FIG. 60, wherein the signal is fed over a transmission line TL having a characteristic impedance $Z_0$ to a primary coil PC, which is magnetically coupled to a secondary coil SC, which is in turn connected to the signal feed comprising a conductive connection to feed port ab having nodes N1 and N2. The transformer PC-SC also acts as a balun to provide and inherently balanced current signal to the signal feed, and to provide impedance matching. FIG. 61 illustrates a signal feed utilizing magnetic induction to couple the signal, applied to terminals T1 and T2, from a primary coil PC directly to the generalized contrawound toroidal helix GCTH.

The primary means of tuning the antenna is by modification of the parameters inherent to the geometry of the generalized contrawound toroidal helical winding, as discussed below. These parameters include the major and minor diameters of the associated toroid form, as well as the number of turns and the type and size of the wire. The specific design relations described herein were developed from experiments which used #15 and #16 gauge solid copper magnet wire with both air and wood cores. Other types and sizes of conductors, or the use of core or surrounding materials with electrical or magnetic properties different from either wood or air, may require tests of the related underlying configurations to establish the relationship between the velocity factor of an electromagnetic wave propagating on a given generalized contrawound toroidal helix, and the geometric and material parameters of the associated generalized contrawound toroidal helix. One technique for making this determination is to measure the fundamental and harmonic resonant frequencies for a variety of structures using an RF network analyzer, such as the Hewlett-Packard model HP8753C. The physical length of the structure, e.g. the axial length of a generalized contrawound linear or toroidal helix, is measured with a scale. At resonance, the electrical length of a dipole-like structure is known to be given by the product of the resonance number times a half-wavelength, so the wavelength $\lambda_g$ of a wave propagating on the structure, i.e. a guided wave, can be calculated by dividing the physical length of the structure by half the resonance number. The resonance number is unity at the fundamental resonance of the structure. The corresponding free space wavelength is found by dividing the speed of light by the signal frequency, and the resulting velocity factor is found as the ratio of the guided wavelength to the free space wavelength. The embodiments of the instant invention normally operate at the fundamental resonance frequency. The velocity factor can be mathematically modeled as a function of the geometric and material properties.

For the case of bifilar contrawound toroidal helix coils constructed with both wood and air cores, the ratio of the axial length of the contrawound toroidal helix—i.e. the circumference of the minor axis of the associated toroid—to the total length of the wire $$\zeta = \frac{L_{axis}}{L_{wire}} \tag{1}$$

proved to be the independent variable which best correlated with the measured velocity factor, in which case the velocity factor was modeled as a power of this ratio, or $$V_g = \alpha \cdot \zeta^{\beta} \tag{2}$$

The parameters α and β were found from a regression analysis and are tabulated in Table 1 for both wood and air cores with both parallel/transmission line and series/loop feed configurations.

TABLE 1

| | Wood Core | | Air Core | |
|---|---|---|---|---|
| Feed Configuration | α | β | α | β |
| parallel/transmission line | 0.7549 | 1.2631 | 0.8756 | 1.3197 |
| series/loop | 0.8274 | 1.2341 | 0.9751 | 1.3061 |

The free space wavelength corresponding to a given design frequency $f_0$ is given by:

$$\lambda_0 = \frac{c}{f_0} \tag{3}$$

where c is the speed of light. By definition of the velocity factor, $$V_g = \frac{\lambda_g}{\lambda_0} \tag{4}$$

and from this, the length of a guided wave on the contrawound helical structure is given by:

$$\lambda_g = \lambda_0 V_g \tag{5}$$

At resonance, the circumferential length of the toroidal helical antenna is designed to be one half of a guided wavelength, or $$L_{Axis} = \frac{\lambda_g}{2} = \frac{\lambda_0}{2} V_g \tag{6}$$

The inverse aspect ratio of the toroidal helix can be expressed in terms of the axis length, and then in terms of the velocity factor as follows:

$$\gamma = \frac{b}{a} = \frac{2\pi b}{2\pi a} = \frac{2\pi b}{L_{Axis}} = \frac{4\pi b}{\lambda_0 V_g} \tag{7}$$

The length of a toroidal helix can be approximated by the length of the corresponding linear helix as, $$V_{g_cyl} = \alpha(1 + (N\gamma)^2)^{-\frac{\beta}{2}} \tag{8}$$

and substituting for γ gives:

$$V_g = \alpha\left(1 + \left(N\left(\frac{4\pi b}{\lambda_0 V_g}\right)\right)^2\right)^{-\frac{\beta}{2}} \tag{9}$$

which simplifies as follows $$\left(\frac{V_g}{\alpha}\right)^{-\frac{2}{\beta}} = 1 + \left(\frac{4\pi bN}{\lambda_0 V_g}\right)^2 \tag{10}$$

$$\sqrt{\left(\frac{V_g}{\alpha}\right)^{-\frac{2}{\beta}} - 1} = \frac{4\pi bN}{\lambda_0 V_g} \tag{11}$$

$$bN = \frac{\lambda_0 V_g \sqrt{\left(\frac{V_g}{\alpha}\right)^{-\frac{2}{\beta}} - 1}}{4\pi} \tag{12}$$

For a given integral number of turns, as required for the realization of a periodic toroidal helical structure, the minor diameter of the toroidal helix, which is measured with respect to the center of the wire elements, is given in terms of the design frequency $f_0$, as $$b = \frac{cV_g \sqrt{\left(\frac{V_g}{\alpha}\right)^{-\frac{2}{\beta}} - 1}}{4\pi N f_0} \tag{13}$$

The size of the major radius, a, of the toroidal helix is determined from (6) which results from the constraint that the length of the major axis, which is the circumferential length of the toroidal helix, must be on half of a guided wavelength, or $$L_{Axis} = 2\pi a = \frac{\lambda_g}{2} = \frac{\lambda_0}{2} V_g \tag{14}$$

which gives $$a = \frac{c}{4\pi f_0} V_g \tag{15}$$

The design process proceeds as follows: Given a desired operating frequency, and a value for the minor radius of the toroidal helix (=minor radius of form +½ wire diameter), Eq. (13) can be solved implicitly for the velocity factor for specified integral numbers of turns (N). The velocity factor is then substituted into Eq. (15) to determine the major radius of the toroidal helical structure.

The associated wire length is approximated by the length of a linear helical winding of length $2\pi a$ and diameter $2\,b$ as follows:

$$L_{wire} = \sqrt{(2\pi Nb)^2 + (2\pi a)^2} = 2\pi a\sqrt{(N\gamma)^2 + 1} \tag{16}$$

A variety of embodiments of the instant invention were constructed using wooden toroidal forms according to FIG. 58, each with a minor radius of 0.375 inches, where for #16 wire the corresponding value of the minor radius of the bifilar contrawound toroidal helix b was 0.4005. Four different multi-ring toroidal forms were used, and these were designated 3A, 3B, 4A and 4B. The 3A and 3B embodiments were collectively housed in proximity to one another. The results of these embodiments are presented in Tables 2–6, infra. Table 2 defines the terminology of the column headings used in Tables 3–6. These embodiments were tuned using an HP8505 RF Network Analyzer. All of the antennas were constructed as a continuous conductor generalized contrawound toroidal helix. All but the embodiments on the 4B form were fed at an H-junction feed ports, while the embodiments on the 4B form were fed at X-junction feed ports. The receiving capability of the winding L embodiment on the 4B form was compared with a conventional military monopole antenna having a manually switchable impedance matching network. Both antennas were connected to separate channels of the RF network analyzer used simultaneously to receive ambient signals. The Winding L embodiment, which was about 8.25 inches in diameter and less than 1 inch high, had a gain of about 3 dB greater than the military monopole antenna which was about 10 feet long.

TABLE 2

| Column Name | Description |
|---|---|
| Form | Toroidal Form ID |
| Winding | Bifilar Contrawound Toroidal Helix ID |
| Feed Type | H = H junction X = X junction (Hybrid-X) |
| a | major radius inches |
| N | Number of turns of #16 copper magnet wire |
| f0_design | Design frequency MHZ |
| Vg_design | Design velocity factor |
| f0: meas/design | Ratio of measured resonant frequency to design resonant frequency |
| f0_meas | Measured resonant frequency MHz |
| Vg_meas | Measured velocity factor |
| f_lo | VSWR = 3 minimum frequency at signal feed |
| f_hi | VSWR = 3 maximum frequency at signal feed |
| bw % | bandwidth at signal feed |
| Rho | reflection coefficient magnitude at resonant frequency |
| Z0 | Signal feed impedance at resonance |
| C1 | SP network C1 picofarads (See FIG. 59) |
| C4 | SP network C4 picofarads (See FIG. 59) |
| L2 | SP network L2 microHenrys (See FIG. 59) |
| L3 | SP network L3 microHenrys (See FIG. 59) |
| f_lo_SPin | VSWR = 3 minimum frequency at input to SP network |
| f0_SPin | Resonant frequency at input to SP network |
| f_hi_SPin | VSWR = 3 maximum frequency at input to SP network |
| bw_% | Bandwidth at input to SP network |

Figure 62:
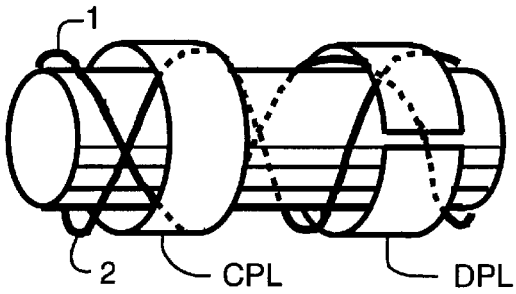
FIG. 62 shows tuning elements in poloidal relationship to a generalized contrawound toroidal helix.
Figure 63:
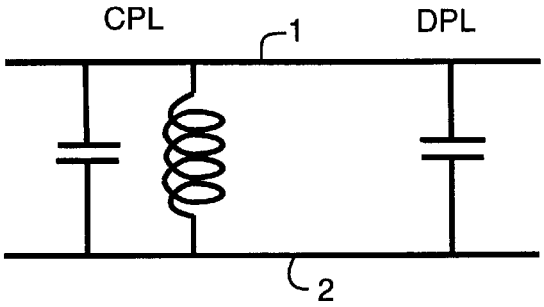
FIG. 63 is an electrical schematic diagram of the embodiment of FIG. 62.
Figure 64:
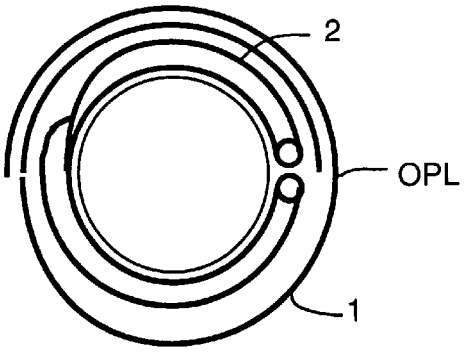
FIG. 64 is an alternate form of a tuning element using a discontinuous conductor.

Given a specific winding configuration, FIGS. 62–64 illustrate several means for tuning the structure by adding a distributed reactance in parallel with the windings by using a separate conductor insulated from and in poloidal relationship to the generalized contrawound toroidal helix. The conductor may be either continuous CPL, adding both inductance and capacitance to the generalized contrawound toroidal helix, or discontinuous DPL or OPL, adding capacitance to the generalized toroidal helix.

Figure 75:
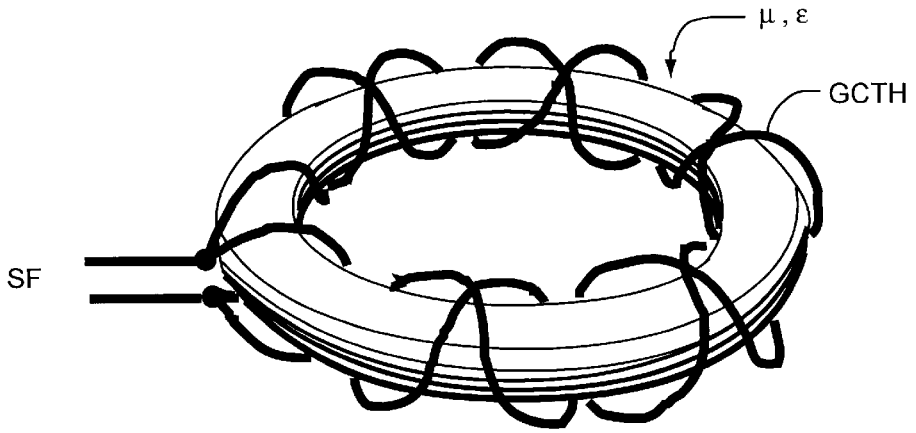
FIG. 75 shows antenna tuning by adjusting the electrical parameters of a toroidal form.

The resonant frequency of the instant invention can also be changed by modifying the magnetic permeability $\mu$ or the electric $\epsilon$ permittivity properties of the toroidal core form of the instant invention, as is illustrated in FIG. 75.

TABLE 3

| Form | Winding | Feed Type | a | N | f0_design | Vg_design |
|---|---|---|---|---|---|---|
| 3A | A | H | 10.975 | 40 | 31.246 | 0.365 |
| 3A | C | H | 9.725 | 33 | 37.824 | 0.392 |
| 3A | E | H | 8.475 | 27 | 46.265 | 0.417 |
| 3A | G | H | 7.225 | 23 | 55.281 | 0.425 |
| 3A | I | H | 5.975 | 21 | 67.054 | 0.427 |
| 3A | K | H | 4.725 | 18 | 79.850 | 0.402 |
| 3B | B | H | 10.350 | 37 | 34.221 | 0.377 |
| 3B | D | H | 9.100 | 30 | 41.844 | 0.405 |
| 3B | F | H | 7.850 | 25 | 51.134 | 0.427 |
| 3B | H | H | 6.600 | 22 | 61.409 | 0.432 |
| 3B | J | H | 5.350 | 19 | 67.054 | 0.382 |
| 3B | L | H | 4.100 | 17 | 84.402 | 0.368 |
| 4A | A | H | 10.98 | 14 | 59.000 | 0.689 |
| 4A | K | H | 4.725 | 22 | 59.000 | 0.297 |
| 4B | B | X | 10.35 | 16 | 59.000 | 0.650 |
| 4B | L | X | 4.1 | 24 | 59.000 | 0.258 |

TABLE 4

| Form | Winding | f0: meas/ design | f0_meas | Vg_meas | f_lo | f_hi | bw % | Rho | Z0 |
|---|---|---|---|---|---|---|---|---|---|
| 3A | A | 0.993 | 31.027 | 0.363 | 28.952 | 32.422 | 11.18 | −0.51 | 1703.6 |
| 3A | C | 0.980 | 37.077 | 0.384 | | | | | 2286.1 |
| 3A | E | 0.984 | 45.508 | 0.411 | 42.561 | 48.325 | 12.67 | −0.55 | 1579.8 |
| 3A | G | 0.993 | 54.914 | 0.422 | 51.706 | 57.316 | 10.22 | −0.41 | 2118.9 |
| 3A | I | 0.946 | 63.413 | 0.403 | | | | | 2413.1 |
| 3A | K | 0.969 | 77.371 | 0.389 | | | | −0.28 | 3102.37 |
| 3B | B | 0.947 | 32.415 | 0.357 | | | | −0.5 | 1737.66 |
| 3B | D | 0.955 | 39.954 | 0.387 | | | | −0.53 | 1639.36 |
| 3B | F | 1.019 | 52.090 | 0.435 | | | | | 1810 |
| 3B | H | 0.944 | 57.948 | 0.407 | | | | −0.51 | 1703.6 |
| 3B | J | 1.044 | 69.976 | 0.399 | | | | −0.36 | 2413.1 |
| 3B | L | 0.939 | 79.264 | 0.346 | | | | −0.36 | 2413.1 |
| 4A | A | 1.121 | 66.165 | 0.773 | 63.263 | 68.882 | 8.49 | −0.39 | 2227.5 |
| 4A | K | 0.973 | 57.401 | 0.289 | 53.607 | 61.027 | 12.93 | −0.52 | 1670.86 |
| 4B | B | 1.051 | 62.009 | 0.683 | 58.704 | 65.073 | 10.27 | −0.41 | 2118.9 |
| 4B | L | 0.806 | 47.539 | 0.208 | 43.752 | 51.778 | 16.88 | −0.64 | 1357.78 |

TABLE 5

| Form | Winding | C1 | C4 | L2 | L3 |
|---|---|---|---|---|---|
| 3A | A | 46.646 | 6.622 | 0.681 | 3.293 |
| 3A | C | 35.77 | 4.507 | 0.605 | 3.484 |
| 3A | E | 32.538 | 4.759 | 0.457 | 2.113 |
| 3A | G | 24.69 | 3.211 | 0.402 | 2.214 |
| 3A | I | 20.58 | 2.536 | 0.357 | 2.126 |
| 3A | K | 15.688 | 1.738 | 0.309 | 2.125 |
| 3B | B | 39.28 | 5.003 | 0.655 | 3.719 |
| 3B | D | 34 | 4.711 | 0.511 | 2.566 |
| 3B | F | 27.28 | 3.781 | 0.41 | 2.059 |
| 3B | H | 24.976 | 3.546 | 0.364 | 1.763 |
| 3B | J | 18.653 | 2.299 | 0.324 | 1.927 |
| 3B | L | 16.467 | 2.029 | 0.286 | 1.7 |
| 4A | A | 24.22 | 3.085 | 0.404 | 2.293 |
| 4A | K | 25.362 | 3.628 | 0.367 | 1.752 |

TABLE 5-continued

| Form | Winding | C1 | C4 | L2 | L3 |
|---|---|---|---|---|---|
| 4B | B | 21.869 | 2.843 | 0.356 | 1.961 |
| 4B | L | 32.628 | 5.06 | 0.425 | 1.79 |

TABLE 6

| Form | Winding | f_lo_SPin | f0_SPin | f_hi_SPin | bw_% |
|---|---|---|---|---|---|
| 3A | A | 29.239 | | 32.030 | 9.00 |
| 3A | C | 33.104 | 33.544 | 35.026 | 5.73 |
| 3A | E | 43.068 | | 47.907 | 10.63 |
| 3A | G | 46.276 | 48.290 | 50.003 | 7.72 |
| 3A | I | 50.254 | 51.600 | 53.278 | 5.86 |
| 3A | K | 78.182 | 80.570 | 83.187 | 6.21 |
| 3B | B | 31.234 | 32.470 | 34.022 | 8.59 |
| 3B | D | 36.875 | 39.360 | 40.593 | 9.45 |
| 3B | F | 44.116 | 45.840 | 47.433 | 7.24 |
| 3B | H | 49.933 | 52.370 | 57.273 | 14.02 |
| 3B | J | 68.164 | 70.776 | 73.096 | 6.97 |
| 3B | L | 81.794 | 84.620 | 87.912 | 7.23 |
| 4A | A | 55.137 | 58.034 | 61.089 | 10.256 |
| 4A | K | 46.543 | 55.145 | 57.844 | 20.493 |
| 4B | B | 54.133 | 59.362 | 62.202 | 13.593 |
| 4B | L | 41.374 | 45.146 | 48.49 | 15.762 |

Figure 65:
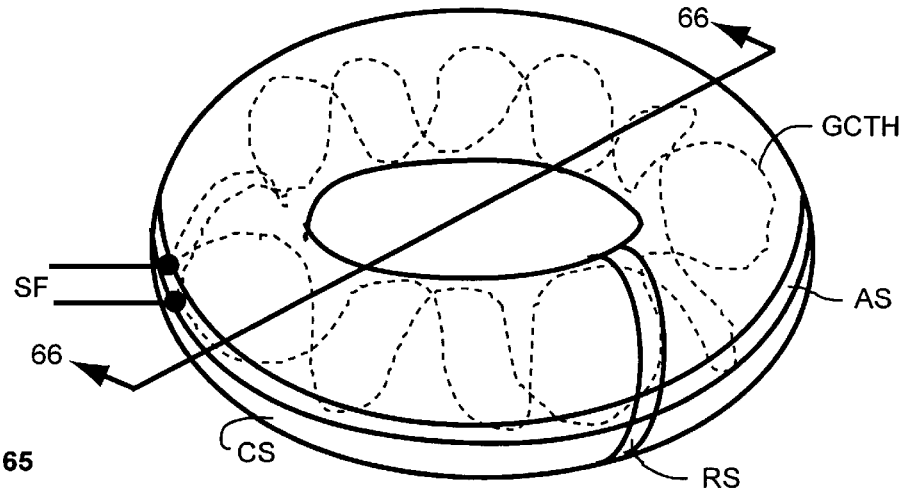
FIG. 65 shows electrostatic shielding of a generalized contrawound toroidal helix by a second conductor.
Figure 66:
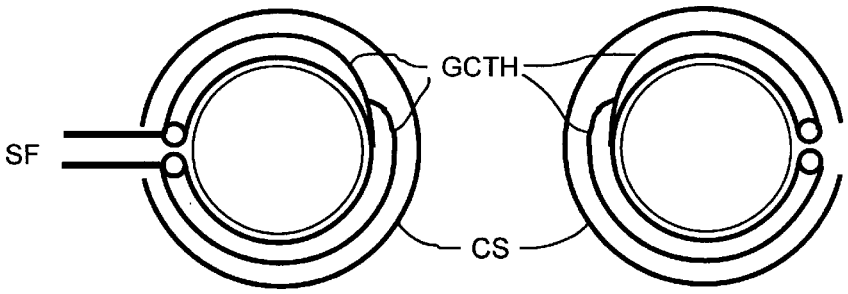
FIG. 66 is a cross section of the embodiment of FIG. 65.
Figure 67:
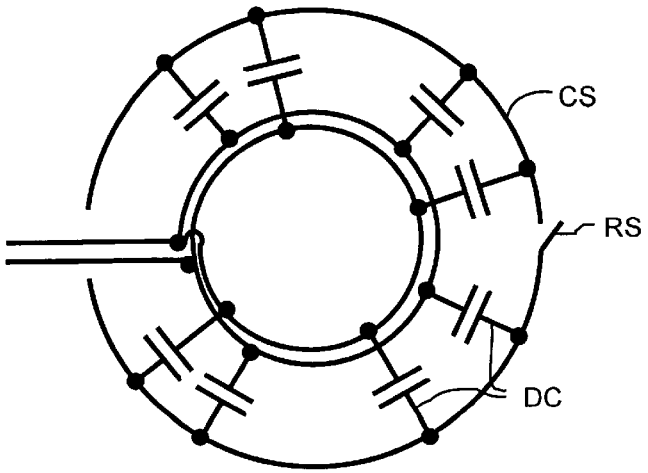
FIG. 67 is an electrical schematic diagram of the embodiment of FIG. 65.

FIGS. 65–67 illustrate a means of surrounding the generalized contrawound toroidal helix GCTH with a concentric conductive toroidal sheath CS which is azimuthally slotted AS at its outermost edge and which is electrically isolated from the contained generalized contrawound toroidal helix and the associated signal feed SF. This slot prevents the azimuthal currents created by the generalized contrawound toroidal helix from inducing poloidal electric currents in the conductive sheath. The conductive sheath may optionally contain radial slots RS. FIG. 66 illustrates a cross section through the FIG. 65 embodiment, while FIG. 67 illustrates the equivalent electrical schematic. The conductive sheath introduces a distributed capacitance DC in parallel with the windings, which can be expected to affect the associated resonant frequency of the structure. The conductive sheath also acts as a Faraday cage to shield the contained generalized contrawound toroidal helix from electrostatic noise.

Figure 68:
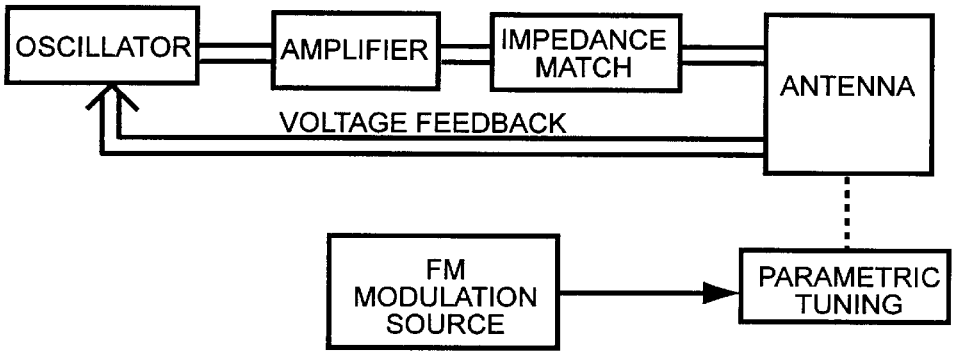
FIG. 68 is an FM modulation system using an antenna with parametric tuning.
Figure 69:
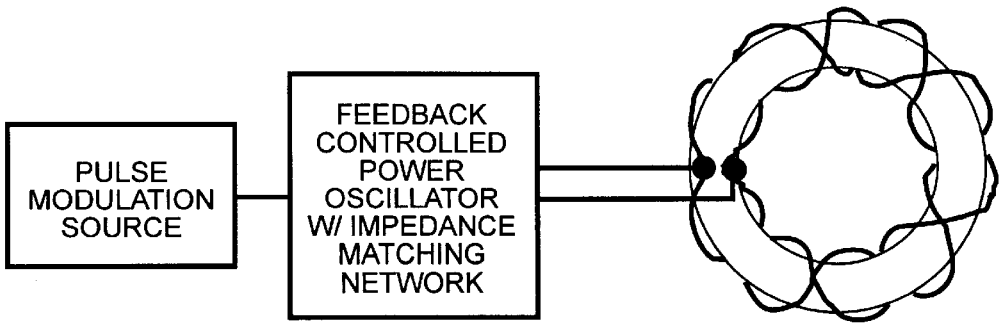
FIG. 69 is a pulse modulation system embodying the instant invention.

FIGS. 68 and 69 illustrate the incorporation of the instant invention as a combined radiator and an oscillator tuning element, whereby the oscillation frequency of associated oscillator, preferably a Class-C oscillator, is controlled by a voltage feedback from the antenna structure. The oscillator and amplifier could be incorporated into a single module which output impedance is matched to the antenna feed port. FIG. 68 illustrates operation as in an FM modulation scheme, whereby the resonant frequency of the antenna element is adjusted by parametrically modifying the permittivity of the structure with a bias voltage, for example using a varactor diode, or the permeability of a toroid with a bias current applied to a poloidal tuning coil in conjunction with a toroid constructed from a material with non-linear magnetic permeability. FIG. 69 illustrates a pulse modulation system whereby the antenna element controls the resonant carrier frequency, and the signal is communicated by modulating the pulse width, pulse position, or pulse frequency of the period during which power is applied to the antenna.

Figure 70:
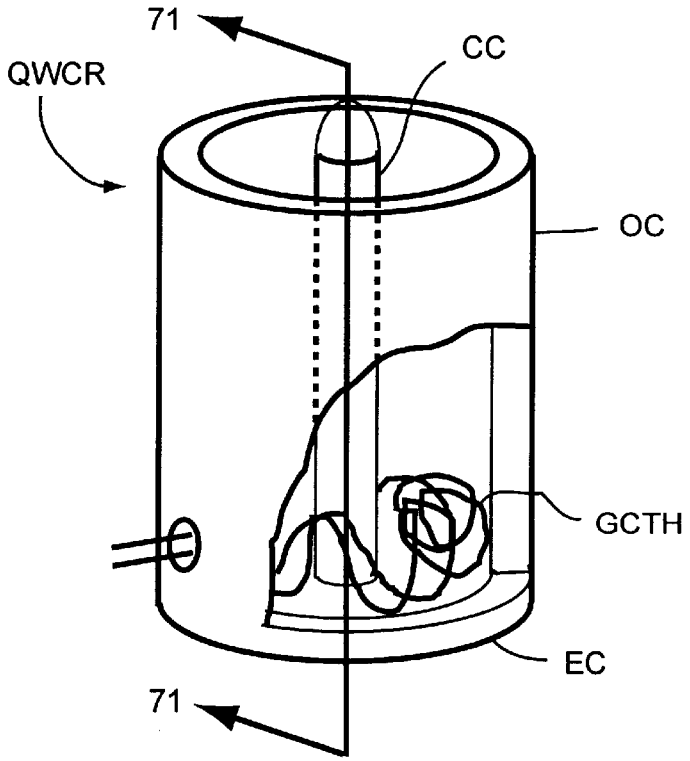
FIG. 70 is a quarter-wave coaxial resonator with a generalized contrawound toroidal helix feed element.
Figure 71:
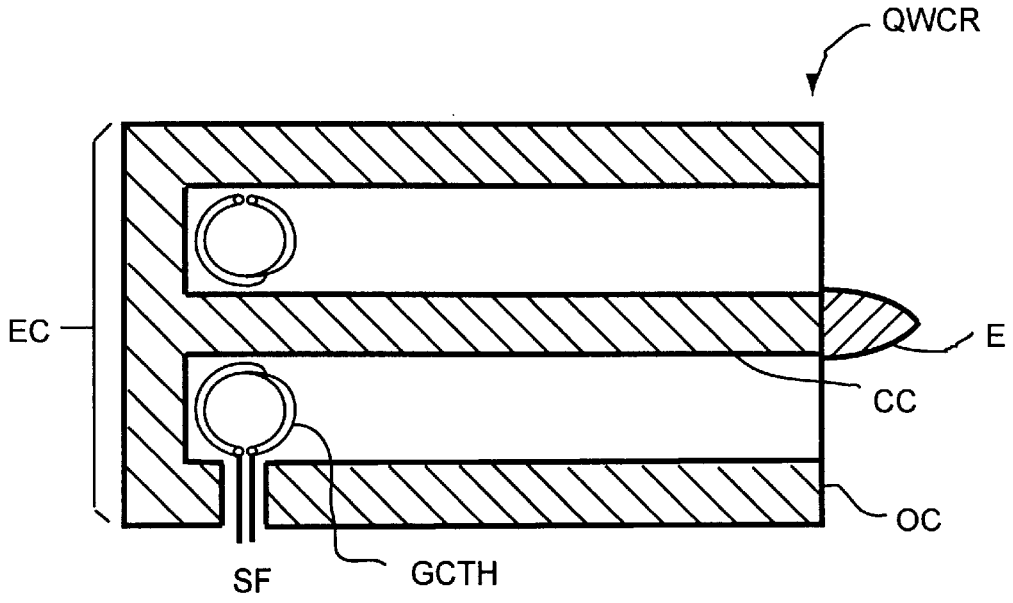
FIG. 71 is cross section of the embodiment of FIG. 70.

FIGS. 70 and 71 illustrate the use of a generalized contrawound toroidal helix as a feed element to a quarter-wave coaxial cavity resonator QWCR which can be used to create a plasma forming RF corona discharge at the tip of a center electrode E, as disclosed in U.S. Pat. No. 5,361,737. The quarter-wave coaxial cavity resonator QWCR comprises concentric center CC and outer OC conductors each electrically shorted to one another at a closed end of the resonator with a closed end conductor EC. The other axial end of the resonator is open, the center conductor CC at which end is terminated with the center electrode E. The quarter-wave coaxial cavity resonator QWCR is fed by introducing a signal to the signal feed SF of a generalized contrawound toroidal helix GCTH, which creates a ring of magnetic current near the closed end conductor EC that energizes a quarter wavelength long resonating wave within the cavity, which resonating wave causes an associated maximum electric field strength at the tip of the center electrode E. The generalized contrawound toroidal helix GCTH could be constructed using a sealed glass tube filled with a rarefied gas, such as neon or argon, which is readily ionized. When excited with a Class-C amplifier, the gas becomes an excellent conductor, enabling pulses of magnetic current to be introduced into the cavity resonator. Without the excitation, this feed element would be non-conducting, and would thus not adversely affect the Q of the cavity resonator.

Figure 72:
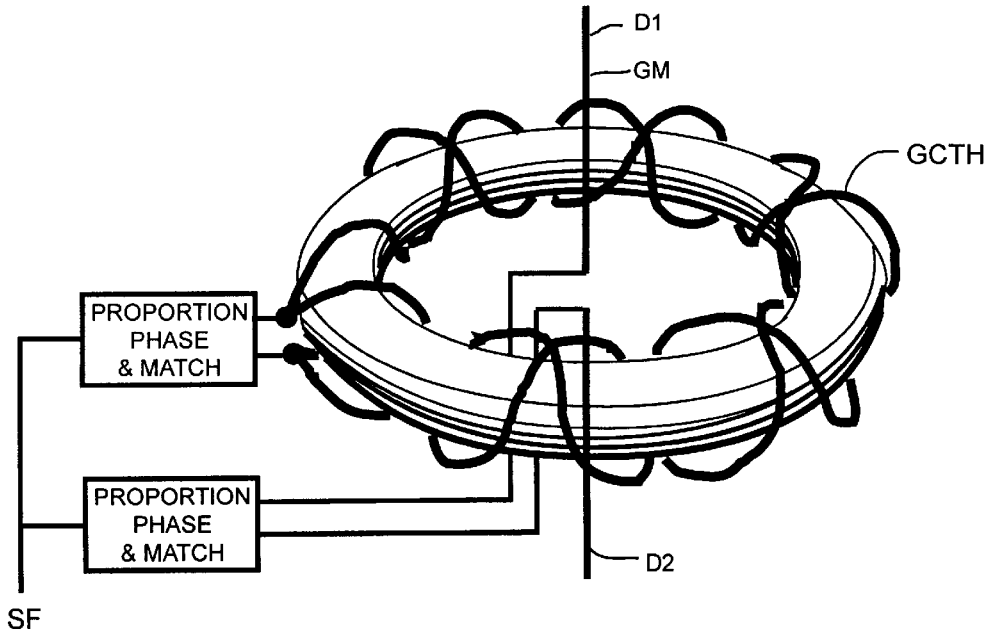
FIG. 72 is a contrawound toroidal helical antenna in an array with a dipole or grounded monopole antenna.
Figure 73:
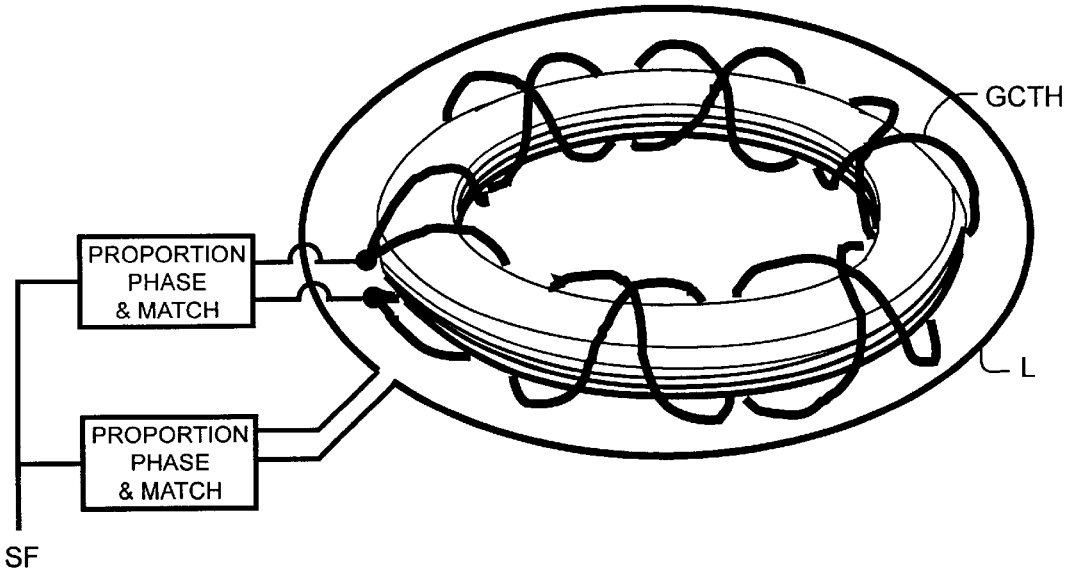
FIG. 73 is a contrawound toroidal helical antenna in an array with a second contrawound toroidal helical antenna.
Figure 74:
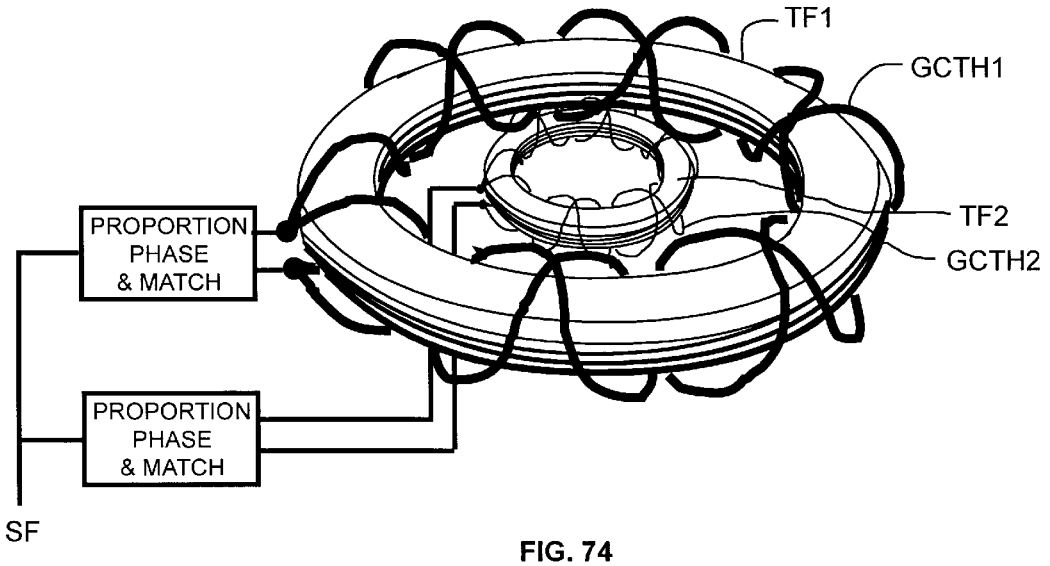
FIG. 74 is a contrawound toroidal helical antenna in an array with an electric loop antenna

The instant invention may be combined with other antenna elements as illustrated in FIGS. 72–74 so as to form an array, whereby each element of the array is operated at a common frequency, and whereby the power applied to each element from common signal feed SF is proportioned and possibly phase shifted with respect to one another so as to shape the associated composite radiation pattern in a useful manner, such as to extend the communication range in a particular direction. FIG. 72 illustrates the combination of a generalized contrawound toroidal helix GCTH with either an electric dipole D1–D2 or a grounded monopole GM. FIG. 73 illustrates the combination of two separate generalized contrawound toroidal helix antenna elements GCTH1 and GCTH2 constructed on respected toroid forms TF1 and TF2, each tuned to the same operating frequency. FIG. 74 illustrates the combination of the generalized contrawound toroidal helix GCTH with an electric loop antenna L, each shown coplanar with one another in a configuration that provides a low profile emulation of a helical dipole antenna.

Figure 76:
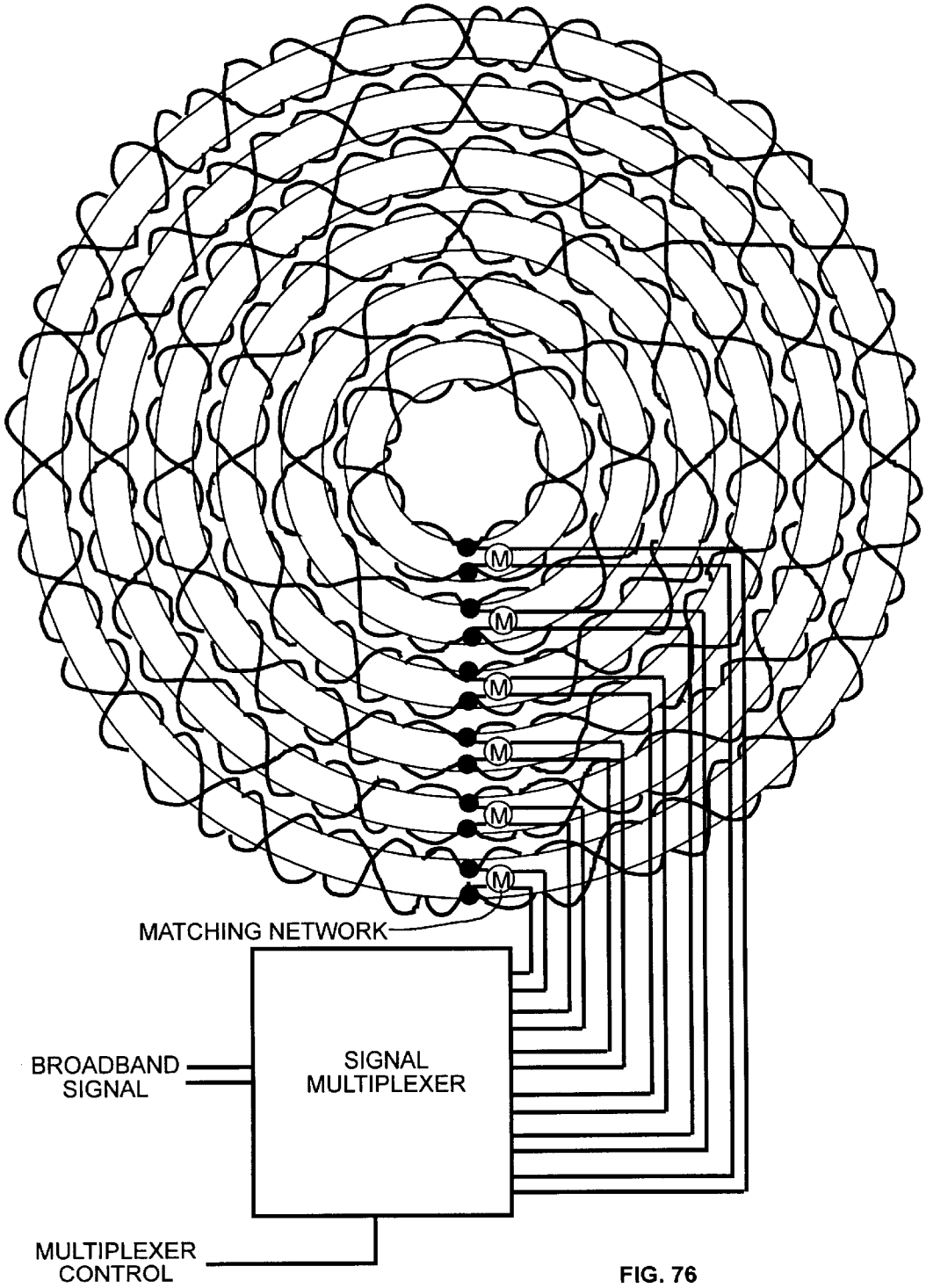
FIG. 76 is a broadband embodiment of the instant invention.

FIG. 76 illustrates a broadband embodiment of the instant invention comprising a plurality of coplanar, concentric generalized contrawound toroidal helix antenna elements, constructed on a form similar in design to that illustrated in FIG. 58, supra., each element tuned so that the associated frequency bands are all adjacent to, or overlapping, the frequency bands of associated elements having the nearest resonant frequencies. Several different FIG. 76 embodiments may be incorporated into a common broadband antenna structure, with each set of rings spaced apart from one another along a common major axis. Each generalized contrawound toroidal helix antenna element has an associated impedance matching network, the inputs to which are connected to a signal multiplexer. A common broadband signal source is applied to the input of the signal multiplexer, and the output port is selected by a multiplexer control signal. Alternately, the signal multiplexer could be replaced by a plurality of receiver, transmitter, or transceiver elements, each connected to a separate antenna element.

Figure 77:
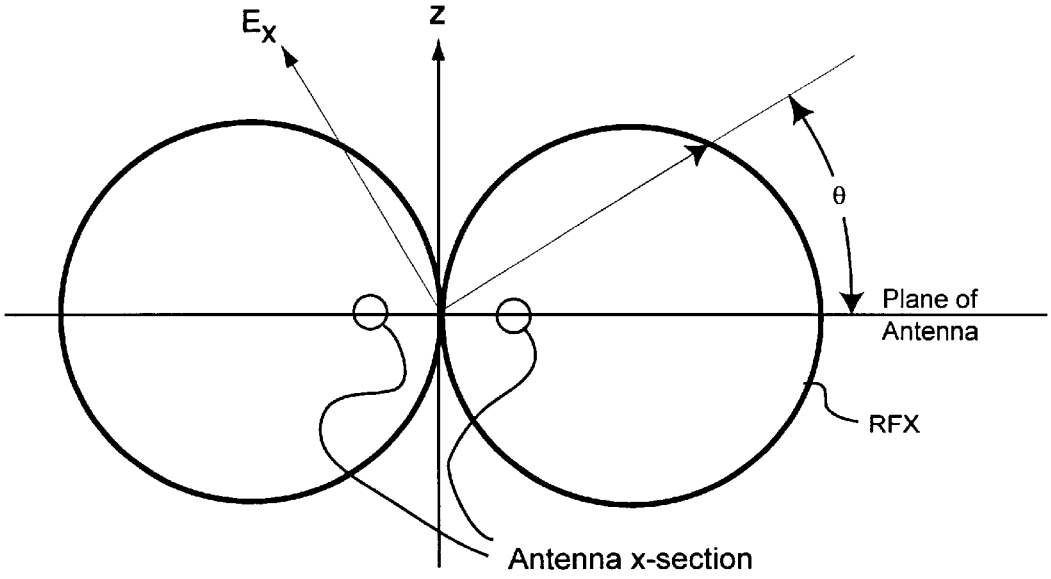
FIG. 77 is an idealized elevation plane radiation pattern of several embodiments of the instant invention.
Figure 78:
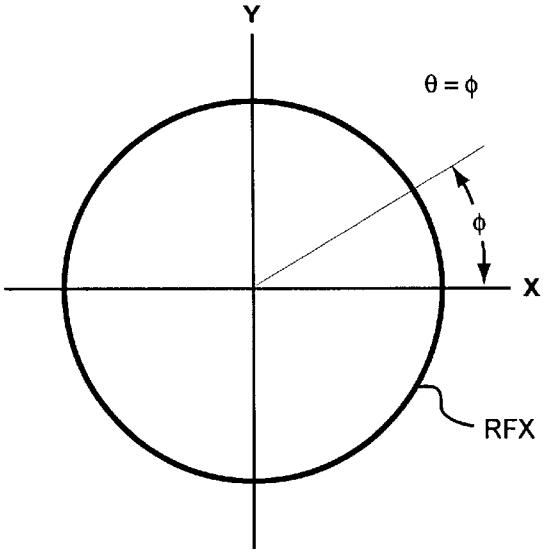
FIG. 78 is an idealized azimuthal plane radiation pattern of several embodiments of the instant invention.

The parallel/transmission line fed and series/loop H-fed embodiments of the instant invention generate an omnidirectional, vertically polarized radiation field RFX comprising propagating electromagnetic waves EX. This radiation field is similar in shape to that of a vertical electric dipole. The elevation and azimuth plane radiation patterns for these embodiments is shown in FIGS. 77 and 78 respectively. The specific shape of the elevation plane radiation pattern is similar to the phi-polarization elevation plane pattern of either a Smith Cloverleaf antenna or a uniform electric current loop which are both known in the art. The difference in shape between the electric dipole or grounded monopole and the generalized contrawound toroidal helix can be exploited in the antenna array of FIG. 72 to extend the communications range of the dipole or grounded monopole antenna.

Figure 79:
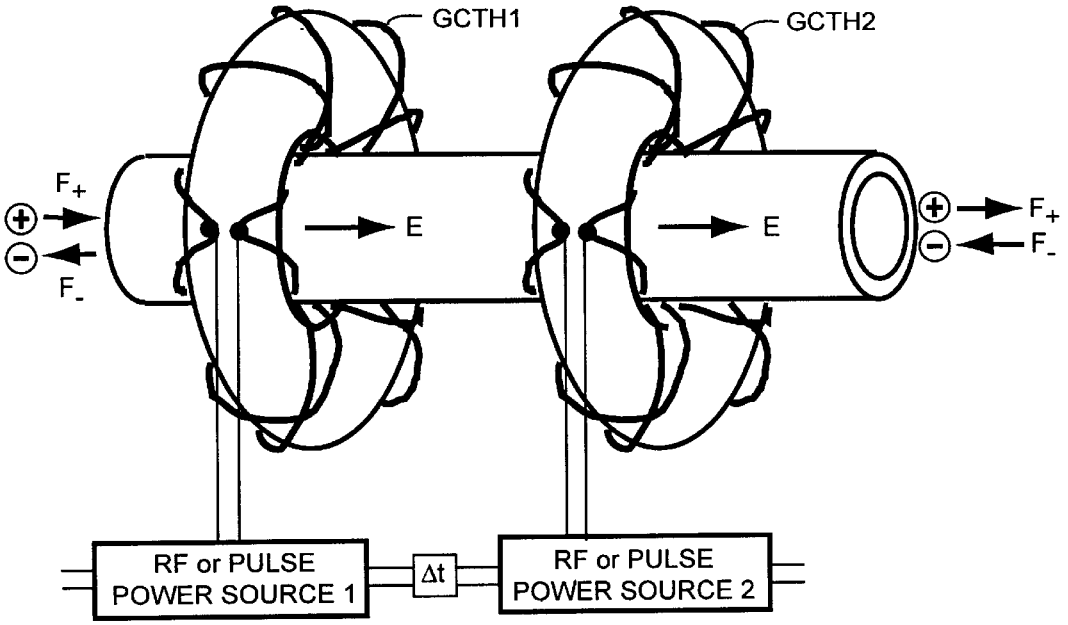
FIG. 79 is a particle accelerator embodying the instant invention.

FIG. 79 illustrates the application of the instant invention for accelerating charged particles within an enclosed tube coaxial with the major axis of the associated generalized contrawound toroidal helix, which is used to generate an axial electric field which accelerates a charged particle. FIG. 79 shows two generalized contrawound toroidal helix accelerator elements GCTH1 and GCTH2, each fed from respective RF or pulse power sources which are timed or phased to be in synchronization with the associated accelerating charged particle.

Figure 80:
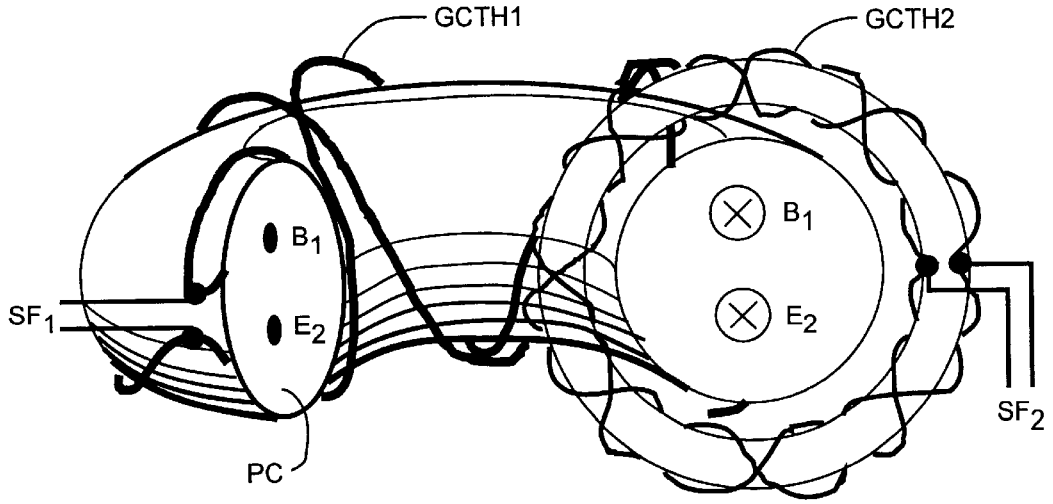
FIG. 80 is a plasma energizer and confinement embodiment of the instant invention.

FIG. 80 illustrates the application of the instant invention for confining and energizing a plasma. A first generalized contrawound toroidal helix GCTH1 fed from a first signal source SF1 generates a toroidal magnetic field B1 which acts confine charged particles within a plasma cavity PC. A second generalized contrawound toroidal helix GCTH2, in poloidal relationship to the first generalized contrawound toroidal helix GCTH1 and fed from a second signal source SF2, generates an axial electric field E2 which is directed toroidally with respect to the plasma cavity PC, so as to toroidally accelerate the charged particles constituting the plasma.

While specific embodiments have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention, which is to be given the full breadth of the appended claims and any and all equivalents thereof.

I claim:

1. An electromagnetic device comprising:

(a) a continuous first conductor comprising a first length portion and a second length portion, said first and second length portions of said continuous first conductor each of substantially the same length and joined to one another at first and second nodes, said first and second length portions each having a first end and a second end, said first end of said first length portion connected to said second end of said second length portion, said second end of said first length portion connected to said first end of said second length portion, the midpoints of said first and second length portions of said continuous first conductor are respective third and fourth nodes;

(b) a generalized toroid having a major axis and a minor axis, said continuous first conductor extending in a generalized helical pattern as a single closed circuit around and over the surface of said generalized toroid, said generalized helical pattern of said first length portion of said continuous first conductor having a first helical pitch sense, said generalized helical pattern of said second length portion of said continuous first conductor having a second helical pitch sense, said first helical pitch sense being opposite to said second helical pitch sense, said first and second length portions of said continuous first conductor insulated from one another and overlapping one another so as to collectively constitute a generalized contrawound toroidal helix, whereby said first and second nodes are in proximate location to one another and collectively constitute a first port on said generalized contrawound toroidal helix, and said third and fourth nodes are in proximate location to one another and collectively constitute a second port on said generalized contrawound toroidal helix;

(c) a signal feed located on said generalized contrawound toroidal helix;

(d) a signal coupler having a first port and a second port, said signal feed in electrical communication with said second port of said signal coupler, said second port of said signal coupler in electrical communication with said first port of said signal coupler;

(e) first and second signal terminals connected respectively to first and second terminals of said first port of said signal coupler.

2. An electromagnetic device as recited in claim 1 wherein said signal feed comprises a conductive connection to said first port on said generalized contrawound toroidal helix.

3. An electromagnetic device as recited in claim 2 wherein said first port of said signal coupler is directly connected to said first port on said generalized contrawound toroidal helix.

4. An electromagnetic device as recited in claim 2 wherein said first port of said signal coupler is magnetically coupled to said second port of said signal coupler.

5. An electromagnetic device as recited in claim 1 wherein said signal feed comprises a conductive connection to said second port on said generalized contrawound toroidal helix.

6. An electromagnetic device as recited in claim 5 wherein said first port of said signal coupler is directly connected to said second port on said generalized contrawound toroidal helix.

7. An electromagnetic device as recited in claim 5 wherein said first port of said signal coupler is magnetically coupled to said second port of said signal coupler.

8. An electromagnetic device as recited in claim 1 wherein said signal feed comprises a magnetic inductive connection to said generalized contrawound toroidal helix.

9. An electromagnetic device as recited in claim 1 wherein said signal coupler includes an impedance matching network between said first and second ports of said signal coupler.

10. An electromagnetic device as recited in claim 1 wherein said first port of said signal coupler is connected to a transceiver with an transceiver output impedance and said transciever output impedance is matched to the impedance at said first port of said signal coupler.

11. An electromagnetic device as recited in claim 1 further comprising a second conductor capacitively coupled to said generalized contrawound toroidal helix.

12. An electromagnetic device as recited in claim 11 wherein said second conductor is in poloidal relationship to said generalized contrawound toroidal helix.

13. An electromagnetic device as recited in claim 12 wherein said second conductor is continuous.

14. An electromagnetic device as recited in claim 12 wherein said second conductor is discontinuous.

15. An electromagnetic device as recited in claim 11 wherein said second conductor electrostatically shields said generalized contrawound toroidal helix.

16. An electromagnetic device as recited in claim 1 further comprising:

(a) an oscillator having a oscillation control input, and a signal output port;

(b) an amplifier having a signal input port, an output port and a power source, said amplifier signal input port in electrical communication with said oscillator signal output port; said amplifier output port connected to said first port of said signal coupler;

(c) a sensor which senses the signal strength in said generalized contrawound toroidal helix, said sensor having an output port;

(d) a feedback network having an input port and an output port, said feedback network input port in electrical communication with said sensor output port, said feedback network output port in electrical communication with said oscillation control input, the combination of said oscillator, said amplifier, said sensor, and said feedback network constituting an amplified feedback oscillator which oscillates at the resonant frequency of said generalized contrawound toroidal helix;

(e) a first signal port in electrical communication with a power source controller for switching the power to said power source of said amplifier whereby the radiated output from said generalized contrawound toroidal helix is controlled by pulse modulation.

17. An electromagnetic device as recited in claim 16 further comprising:

(a) a parametric tuner which changes an electromagnetic wave speed controlling parameter of the generalized contrawound toroidal helix in response to a signal applied to the input of said parametric tuner;

(b) a second signal port in electrical communication with the input of said parametric tuner, the signal applied to said second signal port controlling the resonant frequency of said generalized contrawound toroidal helix thereby modulating the frequency of said amplified feedback oscillator.

18. An electromagnetic device as recited in claim 17 wherein said generalized toroid is constructed from a toroid core material and said electromagnetic wave speed controlling parameter is the permeability of said toroid core material.

19. An electromagnetic device as recited in claim 17 wherein said electromagnetic wave speed controlling parameter is the capacitance between said generalized contrawound toroidal helix and a second conductor.

20. An electromagnetic device as recited in claim 1 further comprising:

(a) a co-located electromagnetic antenna located in proximity to said generalized toroid, said co-located electromagnetic antenna having a signal input port;

(b) first and second proportioning and phase networks each having a signal input port and a signal output port, the power of the signal at said signal output ports being proportional to the power of the signal at said respective first and second signal input ports by first and second signal gains respectively, the phase of the signal at said signal output ports being shifted with respect to the phase of the signal at said respective signal input ports by first and second signal phase shifts respectively, said signal input ports connected to a common signal input port, said signal output port of said first proportioning and phase network connected to said first port of said signal coupler, said signal output port of said second proportioning and phase network connected to said signal input port of said co-located electromagnetic antenna;

(c) first and second signal terminals connected respectively to first and second signal terminals of said common signal input port.

21. An electromagnetic device as recited in claim 20 wherein said co-located electromagnetic antenna comprises an electric dipole antenna.

22. An electromagnetic device as recited in claim 20 wherein said co-located electromagnetic antenna comprises a grounded monopole antenna.

23. An electromagnetic device as recited in claim 20 wherein said co-located electromagnetic antenna comprises:

(a) a continuous first conductor comprising a first length portion and a second length portion, said first and second length portions of said continuous first conductor each of substantially the same length and joined to one another at first and second nodes, said first and second length portions each having a first end and a second end, said first end of said first length portion connected to said second end of said second length portion, said second end of said first length portion connected to said first end of said second length portion, the midpoints of said first and second length portions of said continuous first conductor are respective third and fourth nodes;

(b) a generalized toroid having a major axis and a minor axis, said continuous first conductor extending in a generalized helical pattern as a single closed circuit around and over the surface of said generalized toroid, said generalized helical pattern of said first length portion of said continuous first conductor having a first helical pitch sense, said generalized helical pattern of said second length portion of said continuous first conductor having a second helical pitch sense, said first helical pitch sense being opposite to said second helical pitch sense, said first and second length portions of said continuous first conductor insulated from one another and overlapping one another so as to collectively constitute a generalized contrawound toroidal helix, whereby said first and second nodes are in proximate location to one another and collectively constitute a first port on said generalized contrawound toroidal helix, and said third and fourth nodes are in proximate location to one another and collectively constitute a second port on said generalized contrawound toroidal helix;

(c) a signal feed located on said generalized contrawound toroidal helix;

(d) a signal coupler having a first port and a second port, said signal feed in electrical communication with said second port of said signal coupler, said second port of said signal coupler in electrical communication with said first port of said signal coupler;

(e) first and second signal terminals connected respectively to first and second terminals of said first port of said signal coupler.

24. An electromagnetic device as recited in claim 20 wherein said co-located electromagnetic antenna comprises an electric loop antenna.

25. An electromagnetic device as recited in claim 1 wherein said generalized toroid is a material with a material property affecting the speed of electromagnetic waves propagating on said generalized contrawound toroidal helix.

26. An electromagnetic device as recited in claim 25 wherein said material property is electrical permittivity.

27. An electromagnetic device as recited in claim 25 wherein said material property is electrical permeability.

28. An electromagnetic device as recited in claim 25 wherein said generalized toroid is capacitively coupled to said generalized contrawound toroidal helix.

29. An electromagnetic antenna comprising:

(a) a continuous conductor comprising a first length portion and a second length portion, said first and second length portions of said continuous conductor each of substantially the same length and joined to one another at first and second nodes, said first and second length portion each having a first end and a second end, said first end of said first length portion connected to said second end of said second length portion, said second end of said first length portion connected to said first end of said second length portion;

(b) a generalized toroid having a major axis and a minor axis, said continuous conductor extending in a generalized helical pattern as a single closed circuit around and over the surface of said generalized toroid, said generalized helical pattern of said first length portion of said continuous conductor having a first helical pitch sense, said generalized helical pattern of said second length portion of said continuous conductor having a second helical pitch sense, said first helical pitch sense being opposite to said second helical pitch sense, said first and second length portions of said continuous conductor insulated from one another and overlapping one another so as to collectively constitute a generalized contrawound toroidal helix, said first end of said first length portion of said continuous conductor overlapping said first end of said second length portion of said continuous conductor, said second end of said first length portion of said continuous conductor overlapping with said second end of said second length portion of said continuous conductor, whereby said first and second nodes are in proximate location to one another and collectively constitute a first port on said generalized contrawound toroidal helix;

(c) first and second signal terminals connected respectively to said first and second nodes of said first port on said generalized contrawound toroidal helix.

30. An electromagnetic antenna comprising:

(a) a continuous conductor comprising a first length portion and a second length portion, said first and second length portions of said continuous conductor each of substantially the same length and joined to one another at first and second nodes, said first and second length portions each having a first end and a second end, said first end of said first length portion connected to said second end of said second length portion, said second end of said first length portion connected to said first end of said second length portion;

(b) a generalized toroid having a major axis and a minor axis, said continuous conductor extending in a generalized helical pattern as a single closed circuit around and over the surface of said generalized toroid, said generalized helical pattern of said first length portion of said continuous conductor having a first helical pitch sense, said generalized helical pattern of said second length portion of said conductor having a second helical pitch sense, said first helical pitch sense being opposite to said second helical pitch sense, said first and second length portions of said continuous conductor insulated from one another and overlapping one another so as to collectively constitute a generalized contrawound toroidal helix, said first end of said first length portion of said continuous conductor overlapping said first end of said second length portion of said continuous conductor, said second end of said first length portion of said continuous conductor overlapping with said second end of said second length portion of said continuous conductor, whereby said first and second nodes are in proximate location to one another and collectively constitute a first port on said generalized contrawound toroidal helix;

(c) an impedance matching network having first and second ports, each said port comprising first and second terminals, said second port of said impedance matching network connected to said first port on said generalized contrawound toroidal helix, whereby said impedance matching network transforms the impedance between said first second ports of said impedance matching network;

(d) first and second signal terminals connected respectively to said first and second terminals of said first port of said impedance matching network.

31. An electromagnetic antenna comprising:

(a) a continuous conductor comprising a first length portion and a second length portion, said first and second length portions of said continuous conductor each of substantially the same length and joined to one another at first and second nodes, said first and second length portions each having a first end and a second end, said first end of said first length portion connected to said second end of said second length portion, said second end of said first length portion connected to said first end of said second length portion;

(b) a generalized toroid having a major axis and a minor axis, said continuous conductor extending in a generalized helical pattern as a single closed circuit around and over the surface of said generalized toroid, said generalized helical pattern of said first length portion of said continuous conductor having a first helical pitch sense, said generalized helical pattern of said second length portion of said continuous conductor having a second helical pitch sense, said first helical pitch sense being opposite to said second helical pitch sense, said first and second length portions of said continuous conductor insulated from one another and overlapping on another so as to collectively constitute a generalized contrawound toroidal helix, said first end of said first length portion of said continuous conductor overlapping said first end of said second length portion of said continuous conductor, said second end of said first length portion of said continuous conductor overlapping with said second end of said second length portion of said continuous conductor, whereby said first and second nodes are in proximate location to one another and collectively constitute a first port on said generalized contrawound toroidal helix;

(c) a transceiver having an output port connected to a transceiver output circuit, said output port connected to said first port on said generalized contrawound toroidal helix, said transceiver output circuit having a transceiver output impedance, said transceiver output circuit adapted so that said transceiver output impedance is matched to the impedance of said first port on said generalized contrawound toroidal helix.

32. An electromagnetic antenna comprising:

(a) a first continuous conductor comprising first and second length portions of said first continuous conductor, said first and second length portions of said first continuous conductor each of substantially the same length and joined to one another at first and second nodes of said first continuous conductor;

(b) a second continuous conductor comprising first and second length portions of said second continuous conductor, said first and second length portions of said second continuous conductor each of substantially the same length and joined to one another at first and second nodes of said second continuous conductor;

(c) a generalized toroid having a major axis and a minor axis, said first continuous conductor extending in a first generalized helical pattern as a single closed circuit around and over the surface of said generalized toroid, said second continuous conductor extending in a second generalized toroid, said second continuous conductor extending in a second generalized helical pattern as a single closed circuit around and over the surface of said generalized toroid in overlapping relationship to said first continuous conductor, said first and second continuous conductors insulated from one another, the helical pitch sense of said second generalized helical pattern opposite to the helical pitch sense of said first generalized helical pattern, said first and second continuous conductors constituting a generalized contrawound toroidal helix, said first node of said first continuous conductor in proximity to said first nodes of said second continuous conductor, both said first nodes collectively constituting a first port on said generalized contrawound toroidal helix, said second node of said first continuous conductor in proximity to said second node of said second continuous conductor, both said second nodes collectively constituting a second port on said generalized contrawound toroidal helix, said first and second ports on said generalized contrawound toroidal helix diametrically opposite to one another;

(d) first and second signal terminals connected only to said first port on said generalized contrawound toroidal helix.

33. A method of transmitting an electromagnetic signal, comprising the steps:

(a) applying a signal through first and second terminals such that the currents in said terminals flows in opposite directions; and (b) conducting said currents from said signal terminals to a pair of first and second nodes on a continuous conductor, said nodes dividing said continuous conductor into first and second length portions each of substantially the same length, said first and second length portions each having a first end and a second end, said first end of said first length portion connected to said second end of said second length portion, said second end of said first length portion connected to said first end of said second length portion, said continuous conductor extending in a generalized helical pattern as a single closed circuit around and over the surface of a generalized toroid, said generalized helical pattern of said first length portion having a first helical pitch sense, said generalized helical pattern of said second length portion having a second helical pitch sense, said first helical pitch sense being opposite to said second helical pitch sense, said first and second length portions of said continuous conductor insulated from one another and overlapping one another so as to collectively constitute a generalized contrawound toroidal helix.

34. A method of transmitting an electromagnetic signal as recited in claim 33 further comprising the step of transforming the impedance at said first and second terminals to match the impedance at said first and second nodes.

35. A method of transmitting an electromagnetic signal as recited in claim 33 further comprising the step of applying a signal from an amplified oscillator to said first and second signal terminals and using feedback from said first and second signal terminals for modifying the tuning of said amplified oscillator.

36. A method of transmitting an electromagnetic signal as recited in claim 35 wherein said amplified oscillator is tuned to operate at the resonant frequency of said generalized contrawound toroidal helix.

37. A method of transmitting an electromagnetic signal as recited in claim 36 further comprising the step of modifying the resonant frequency of said generalized contrawound toroidal helix by varying an electromagnetic wave speed controlling parameter associated with said generalized contrawound toroidal helix in response to a modulation signal.

38. A method of transmitting an electromagnetic signal as recited in claim 36 further comprising the step of modifying the amplification of said amplified oscillator in response to a modulation signal.

39. A method of transmitting an electromagnetic signal as recited in claim 33 further comprising the step of applying a signal from an amplified oscillator to said first and second signal terminals and using feedback from said first and second signal terminals for modifying the amplification of said amplified oscillator.

40. A method of transmitting an electromagnetic signal as recited in claim 39 further comprising the step of modifying the amplification of said amplified oscillator in response to a modulation signal.

41. A method of transmitting an electromagnetic signal as recited in claim 33 further comprising the steps:

(a) proportioning and phase shifting the signal by a first gain and a first phase shift so as to form a first proportioned and phase shifted signal, and applying said first proportioned and phase shifted signal to said first and second signal terminals;

(b) proportioning and phase shifting the signal by a second gain and a second phase shift so as to form a second proportioned and phase shifted signal, and applying said second proportioned and phase shifted signal to the signal input port of a co-located electromagnetic antenna.

42. A method of transmitting an electromagnetic signal as recited in claim 41 wherein said co-located electromagnetic antenna comprises an electric dipole antenna.

43. A method of transmitting an electromagnetic signal as recited in claim 41 wherein said co-located electromagnetic antenna comprises a grounded monopole antenna.

44. A method of transmitting an electromagnetic signal as recited in claim 41 wherein said co-located electromagnetic antenna comprises:

(a) a continuous first conductor comprising a first length portion and a second length portion, said first and second length portions of said continuous first conductor each of substantially the same length and joined to one another at first and second nodes, said first and second length portions each having a first end and a second end, said first end of said first length portion connected to said second end of said second length portion, said second end of said first length portion connected to said first end of said second length portion, the midpoints of said first and second length portions of said continuous first conductor are respective third and fourth nodes;

(b) a generalized toroid having a major axis and a minor axis, said continuous first conductor extending in a generalized helical pattern as a single closed circuit around and over the surface of said generalized toroid, said generalized helical pattern of said first length portion of said continuous first conductor having a first helical pitch sense, said generalized helical pattern of said second length portion of said continuous first conductor having a second helical pitch sense, said first helical pitch sense being opposite to said second helical pitch sense, said first and second length portions of said continuous first conductor insulated from one another and overlapping one another so as to collectively constitute a generalized contrawound toroidal helix, whereby said first and second nodes are in proximate location to one another and collectively constitute a first port on said generalized contrawound toroidal helix, and said third and fourth nodes are in proximate location to one another and collectively constitute a second port on said generalized contrawound toroidal helix;

(c) a signal feed located on said generalized contrawound toroidal helix;

(d) a signal coupler having a first port and a second port, said signal feed in electrical communication with said second port of said signal coupler, said second port of said signal coupler in electrical communication with said first port of said signal coupler;

(e) first and second signal terminals connected respectively to first and second terminals of said first port of said signal coupler.

45. A method of transmitting an electromagnetic signal as recited in claim 41 wherein said co-located electromagnetic antenna comprises an electric loop antenna.

46. A method of constructing an antenna, comprising the steps:

(a) beginning at a point of origin on the surface of a generalized toriod having a major axis and a minor axis, placing a first point of a conductor at said point of origin, proceeding in a first direction along said minor axis of said generalized toroid, placing a first length portion of a conductor over said surface of said generalized toroid in a generalized helical pattern with a first helical pitch sense until returning to a point of return in proximity to said point of origin on said surface of said generalized toroid, whereby said point of return is a first node;

(b) proceeding in a second direction along said minor axis of said generalized toroid, placing a second length portion of said conductor over said surface of said generalized toroid in a generalized helical pattern with a second helical pitch sense until returning to said point of origin at a second point on said conductor, said second helical pitch sense being opposite to said first helical pitch sense, said first and second length portions of said conductor insulated from one another;

(c) electrically connecting said first point of said conductor to said second point of said conductor so as to form a continuous conductor, whereby the point of connection is a second node, said first and second length portions of said conductor constitute a generalized contrawound toroidal helix, the midpoints of said first and second length portions of said conductor are third and fourth nodes, said first and second nodes constitute a first port on said generalized contrawound toroidal helix, and said third and fourth nodes constitute a second port on said generalized contrawound toroidal helix.

47. A method of constructing an electromagnetic antenna as recited in claim 46 wherein said second direction along said minor axis of said generalized toroid is the same as said first direction along said minor axis of said generalized toroid.

48. A method of constructing an electromagnetic antenna as recited in claim 47 wherein said first length portion of said conductor is interleaved with said second length portion of said conductor.

49. An electromagnetic antenna for use with an antenna signal, said electromagnetic antenna comprising:

(a) a generalized toroid;

(b) first insulated conductor means extending in a first partially helical conductive path around and at least partially over said generalized toroid with at least a first helical pitch sense;

(c) second insulated conductor means extending in a second partially helical conductive path around and at least partially over said generalized toroid with at least a second helical pitch sense, which is opposite from the first helical pitch sense, in order that said first and second insulated conductor means are contrawound relative to each other around and at least partially over said generalized toroid, with said first and second insulated conductors connected to one another so as to form a single conductor; and (d) first and second signal terminals respectively electrically connected to said first and second insulated conductor means.

50. The electromagnetic antenna of claim 49 wherein said generalized toroid is a multiply connected surface having a major axis and at least one generally flat surface which is generally perpendicular to the major axis, with the first and second partially helical conductive paths, when generally perpendicular to the major axis of said multiply connected surface, being generally radial with respect to the major axis of said multiply connected surface, and otherwise being generally helically oriented.

51. The electromagnetic antenna of claim 50 wherein said first insulated conductor means extends in the first partially helical conductive path around and over said multiply connected surface with the first helical pitch sense from a first node to a second node; and wherein said second insulated conductor means extends in the second partially helical conductive path around and over said multiply connected surface with the second helical pitch sense from the second node to the first node in order that the first and second partially helical conductive paths are contrawound relative to each other and form a single endless conductive path around and over said multiply connected surface; and wherein said first and second signal terminals are respectively electrically connected to the first and second nodes.

52. The electromagnetic antenna of claim 50 wherein said first insulated conductor means extends in the first partially helical conductive path around and over said multiply connected surface with the first helical pitch sense from a first node to a second node and from the second node to a third node; wherein said second insulated conductor means extends in the second partially helical conductive path around and over said multiply connected surface with the second helical pitch sense from the third node to a fourth node and from the fourth node to the first node in order that the first and second partially helical conductive paths are contrawound relative to each other and form a single endless conductive path around and over said multiply connected surface; and wherein said first and second signal terminals are respectively electrically connected to the second and fourth nodes.

53. The electromagnetic antenna of claim 49 wherein said generalized toroid is a generally spherical surface having a conduit along a major axis thereof, with the first and second partially helical conductive paths passing through the conduit of said generally spherical surface and being generally parallel to the major axis thereof within the conduit, and otherwise being generally helically oriented.

54. The electromagnetic antenna of claim 53 wherein said first insulated conductor means extends in the first partially helical conductive path around and over said generally spherical surface with the first helical pitch sense from a first node to a second node; and wherein said second insulated conductor means extends in the second partially helical conductive path around and over said generally spherical surface with the second helical pitch sense from the second node to the first node in order that the first and second partially helical conductive paths are contrawound relative to each other and form a single endless conductive path around and over said generally spherical surface; and wherein said first and second signal terminals are respectively electrically connected to the first and second nodes.

55. The electromagnetic antenna of claim 53 wherein said first insulated conductor means extends in the first partially helical conductive path around and over said generally spherical surface with the first helical pitch sense from a first node to a second node and from the second node to a third node; wherein said second insulated conductor means extends in the second partially helical conductive path around and over said generally spherical surface with the second helical pitch sense from the third node to a fourth node and from the fourth node to the first node in order that the first and second partially helical conductive paths are contrawound relative to each other and form a single endless conductive path around and over said generally spherical surface; and wherein said first and second signal terminals are respectively electrically connected to the second and fourth nodes.

* * * * *